US007073417B2

(12) United States Patent
Beauchamp

(10) Patent No.: US 7,073,417 B2
(45) Date of Patent: Jul. 11, 2006

(54) COMBINATION SCREW DRIVER AND BIT HOLDER

(76) Inventor: Fern Beauchamp, 13 Clayburn Ave., St. Catharines, Ontario (CA) L2P 2S3

( * ) Notice: Subject to any disclaimer, the term of this patent is extended or adjusted under 35 U.S.C. 154(b) by 0 days.

(21) Appl. No.: 10/076,481

(22) Filed: Feb. 19, 2002

(65) Prior Publication Data

US 2003/0079581 A1 May 1, 2003

Related U.S. Application Data

(63) Continuation-in-part of application No. 09/983,567, filed on Oct. 25, 2001, now Pat. No. 6,761,095.

(51) Int. Cl.
*B25G 1/08* (2006.01)

(52) U.S. Cl. ..... 81/490; 81/177.4

(58) Field of Classification Search ..... 81/177.4, 81/438, 439, 490

See application file for complete search history.

(56) References Cited

U.S. PATENT DOCUMENTS

| | | | | | |
|---|---|---|---|---|---|
| 2,667,194 | A * | 1/1954 | Fischer et al. | ..... | 81/438 |
| 2,833,548 | A * | 5/1958 | Clark | ..... | 81/438 |
| 2,838,082 | A * | 6/1958 | Lange | ..... | 81/438 |
| 4,514,117 | A * | 4/1985 | Scott | ..... | 408/239 R |
| 4,893,529 | A * | 1/1990 | Lin | ..... | 81/439 |
| 5,063,796 | A * | 11/1991 | Gennep | ..... | 81/177.4 |
| 5,740,706 | A * | 4/1998 | Tseng | ..... | 81/490 |
| 5,884,541 | A * | 3/1999 | Habermehl et al. | ..... | 81/438 |
| 5,921,562 | A * | 7/1999 | Robison | ..... | 279/128 |
| 6,053,675 | A * | 4/2000 | Holland et al. | ..... | 408/239 R |
| RE36,797 | E * | 8/2000 | Eggert et al. | ..... | 81/438 |
| 6,163,911 | A | 12/2000 | Lin | | |
| 6,199,872 | B1 * | 3/2001 | Hasan | ..... | 81/438 |
| 6,237,451 | B1 | 5/2001 | Wel | | |
| 6,243,902 | B1 * | 6/2001 | Huang | ..... | 81/490 |
| 6,293,173 | B1 | 9/2001 | Rowlay | | |
| 6,305,255 | B1 | 10/2001 | Wu | | |
| 6,332,384 | B1 * | 12/2001 | Cluthe | ..... | 81/490 |
| 2002/0007705 | A1 * | 1/2002 | Beauchamp | ..... | 81/490 |
| 2003/0079580 | A1 * | 5/2003 | Beauchamp | ..... | 81/490 |

* cited by examiner

*Primary Examiner*—Lee D. Wilson
*Assistant Examiner*—Anthony Ojini

(57) ABSTRACT

The present invention a combination screwdriver and bit holder for use with a drill chuck includes a shaft adapted at one end for releasably mounting to the drill chuck, and at the other end for releasably mounting tool bits therein; and, a housing connected operably to said shaft, said housing defining bit compartments for releasably receiving tool bits therein. Preferably the bit holder used in combination with a handle adapted at one end for releasably receiving said bit holder such that said handle mated together with said bit holder can be used as manual combination screwdriver.

25 Claims, 26 Drawing Sheets

100
110
111
112
114
116
118
126
130
144

124
122
130
152
112
118
116
140
126
150
110
114
180
120
144
111

FIG. - 16
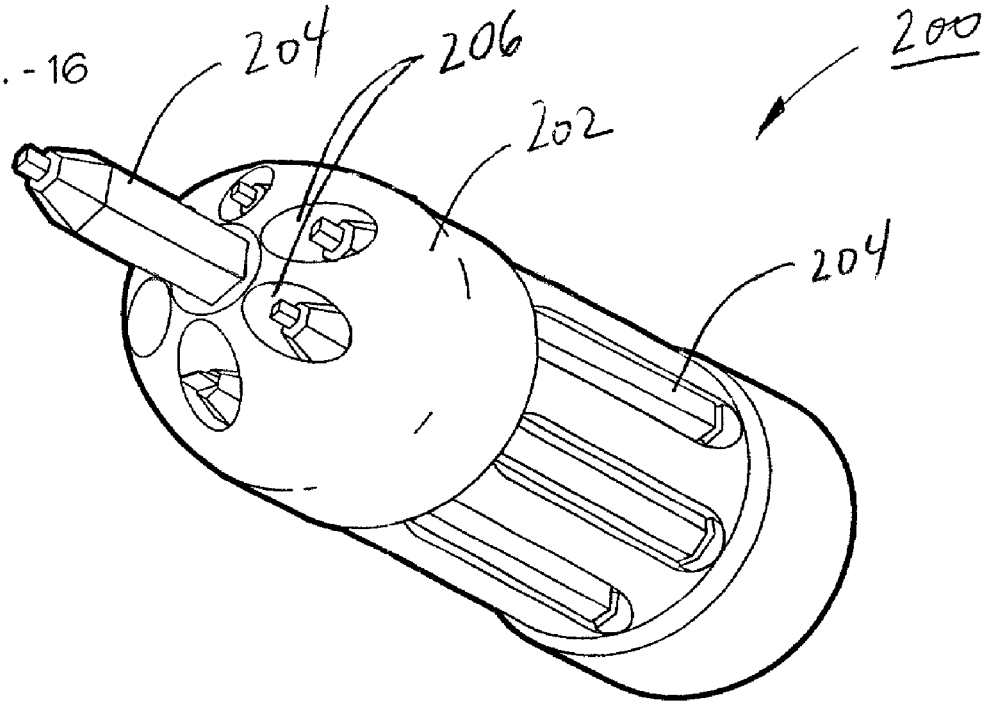
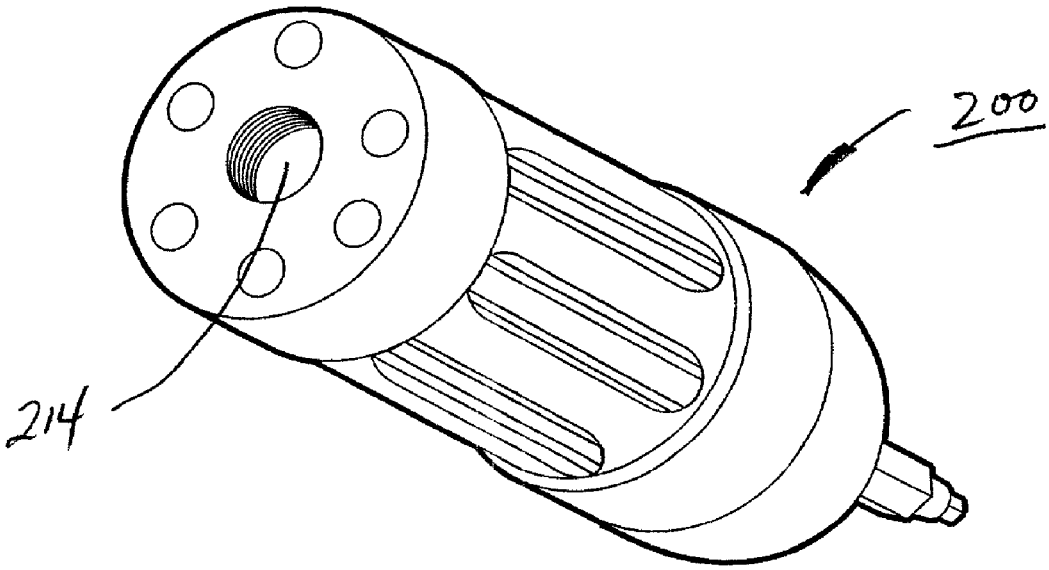
FIG. - 17

230
232
230
200
200

240
242
244
200

242

250

200

244

244

501
532
504
510
500
512
580
570
508
509

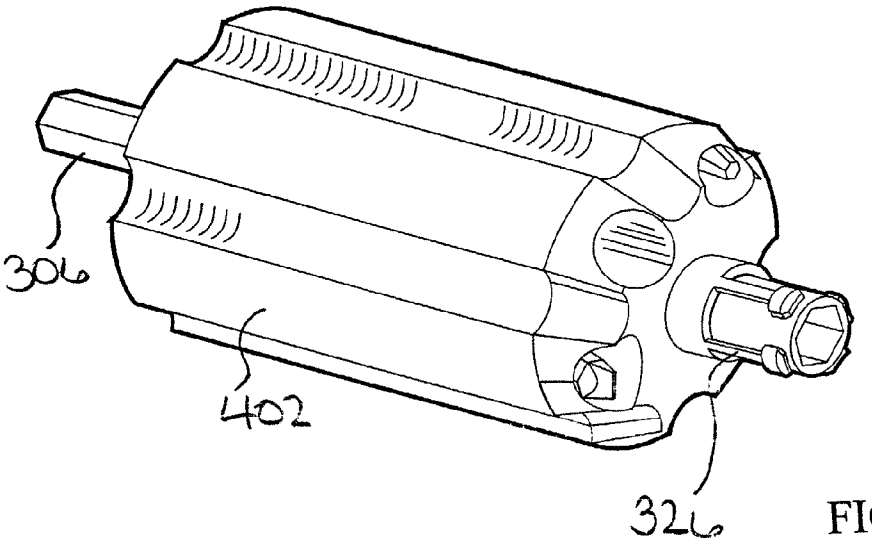
FIG. 63
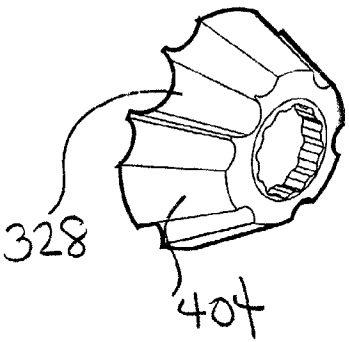
FIG. 64
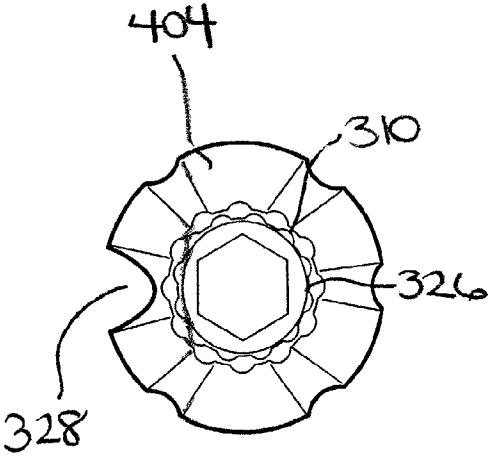

COMBINATION SCREW DRIVER AND BIT HOLDER

CROSS REFERENCE TO RELATED APPLICATION

This application is a continuation in part of our earlier application filed under Ser. No. 09/983,567 on Oct. 25, 2001, now U.S. Pat. No. 6,761,095 under the title BIT HOLDER.

FIELD OF THE INVENTION

The present invention relates generally to power tools and more particularly to a bit holder adapted to be received in a drill chuck.

BACKGROUND OF THE INVENTION

A number of devices are available on the market for releasably holding and storing tools bits in various containers. The major draw back with the existing devices is that each time a tool bit is selected to be inserted into a drill chuck for example, the chuck must be released and the tool bit must be inserted. There are adapters on the market presently which allow for magnetically receiving and releasing tools bits once such an adapter is placed in a chuck of a drill bit. The draw back of these devices is that the tool bits are held separately from the adapter.

Therefore, it is desirable to have a device which combines both the adapter and the tool bit holding container, such that tool bits are readily available any time and in close proximity to the drill chuck and are similar to existing adapters on the market magnetically received in an adapter for easy insertion and removal.

SUMMARY OF THE INVENTION

The present invention a bit holder for use with a drill chuck comprises:

(a) a shaft means adapted at one end for releasably mounting to the drill chuck, and at the other end for releasably mounting tool bits therein; and, (b) a means for releasably storing tool bits in nested fashion around said shaft such that said shaft means and said storing means rotate in unison with said drill chuck.

Preferably wherein said storing means comprises a framework rigidly attached to said shaft means, said framework defining bit compartments for releasably receiving tool bits therein.

Preferably wherein said framework further includes at least two dividers extending radially from said shaft wherein said dividers define side walls of said bit compartments.

Preferably wherein said framework further includes a circular base and cylindrical retainer wherein said retainer base and dividers define the space of each bit compartment.

Preferably wherein said retainer further includes a means for holding said tool bits within each bit compartment and also for selectively releasing a tool bit.

Preferably wherein said hold meanings includes a retainer opening operable to be positioned for selectively releasing a tool bit.

Preferably wherein said retainer rotates about said base for selectively positioning said opening to release a tool bit.

In an alternate embodiment the invention is a bit holder for use with a handle and comprises:

(a) a shaft means adapted at one end for mounting to the handle, and at the other end for releasably mounting tool bits therein; and, (b) a means for releasably storing tool bits in nested fashion around said shaft such that said shaft means and said storing means rotate in unison with said handle.

The present invention a bit holder for use with a drill chuck comprises:

(a) a shaft means adapted at one end for releasably mounting to the drill chuck, and at the other end for releasably mounting tool bits therein; and, (b) a means for releasably storing tool bits in bit compartments located in nested fashion around said shaft such that said shaft means and said storing means rotate in unison with said drill chuck.

Preferably wherein said storing means comprises a housing connected operably to said shaft means, said housing defining bit compartments for releasably receiving tool bits therein.

Preferably wherein said bit holder means further includes a means for retaining said tool bits within each bit compartment and also for selectively releasing a tool bit.

Preferably wherein said retaining meanings includes a sleeve for positioning relative to said housing for selectively retaining or for selectively releasing tool bits in said bit compartments.

Preferably wherein said bit holder further includes said housing and said sleeve operably rotatably relative each other, wherein said housing or sleeve rotate about a longitudinal shaft axis such that rotating said housing or said sleeve relative each other selectively retains or releases said bits from said bit compartments.

Preferably wherein said retaining means includes a means for incrementally rotating said sleeve or housing relative each other in an incremental or clicking fashion about said longitudinal shaft axis, such that said relative rotation is positively registered in predetermined positions or increments.

Preferably said incremental means includes radially disposed grooves and co-operating tongues, such that rotating said sleeve relative to said housing causes said tongues and groves to mesh and releasably maintain said sleeve and housing at predetermined rotational positions.

Preferably wherein said sleeve includes an opening portion for selectively positioning said opening to release a tool bit from a bit compartment while retaining the balance of said bits in said bit compartments.

Preferably wherein said housing further includes bit compartment openings for exposing a portion of a bit within a bit compartment, said compartment opening adapted to allow a user to apply finger pressure to a bit for releasing said bit from said bit compartment.

Preferably wherein said storing means includes magnets for magnetically retaining bits in said bit compartments.

Preferably, wherein said housing includes a threaded aperture proximate one end, said aperture adapted for mounting directly onto a threaded shaft of a drill which normally receives a drill chuck.

Preferably wherein said retaining meanings includes an actuating means for magnetically retaining tool bits within each bit compartment.

Preferably wherein said actuating means includes an actuator assembly slidably received within each bit compartment, wherein said actuator assembly including a magnet housed within a magnet holder for magnetically attracting and retaining a tool bit within a bit compartment.

Preferably wherein said housing further including actuator channels corresponding to each bit compartment, wherein said actuator assembly being slidably received along each actuator channel and bit compartment, wherein said actuator assembly for slidably urging said tool bit longitudinally along said bit compartment.

Preferably wherein said actuator assembly further including a knob connected to said magnet holder, said knob projecting from the exterior of said housing for receiving finger pressure thereon, such that tool bits can be extended and retracted along said bit compartment by urging said knob forwards and backwards along the longitudinal direction which inturn urges said actuator assembly and inturn urges said tool bit forwards and backwards.

Alternatively in combination a bit holder for use with a handle further comprising:

(a) a handle adapted at one end for releasably receiving said bit holder such that said handle mated together with said bit holder can be used as manual combination screwdriver.

Alternatively wherein said handle further includes means for releasably storing tool bits therein such that said tool bits are accessible when said handle is released from said bit holder.

BRIEF DESCRIPTION OF THE DRAWINGS

The invention will now be described by way of example only, with references to the followings drawings in which:

FIG. 16 is a schematic front perspective view of an alternate embodiment of a bit holder 200.

FIG. 17 is a rear perspective schematic view of the alternate embodiment bit holder 200 shown in FIG. 16.

FIG. 63 is a front perspective view of the body and shaft.

FIG. 64 is a front elevational view of the sleeve.

DETAILED DESCRIPTION OF THE PREFERRED EMBODIMENT

Figures 10, 11, 12:
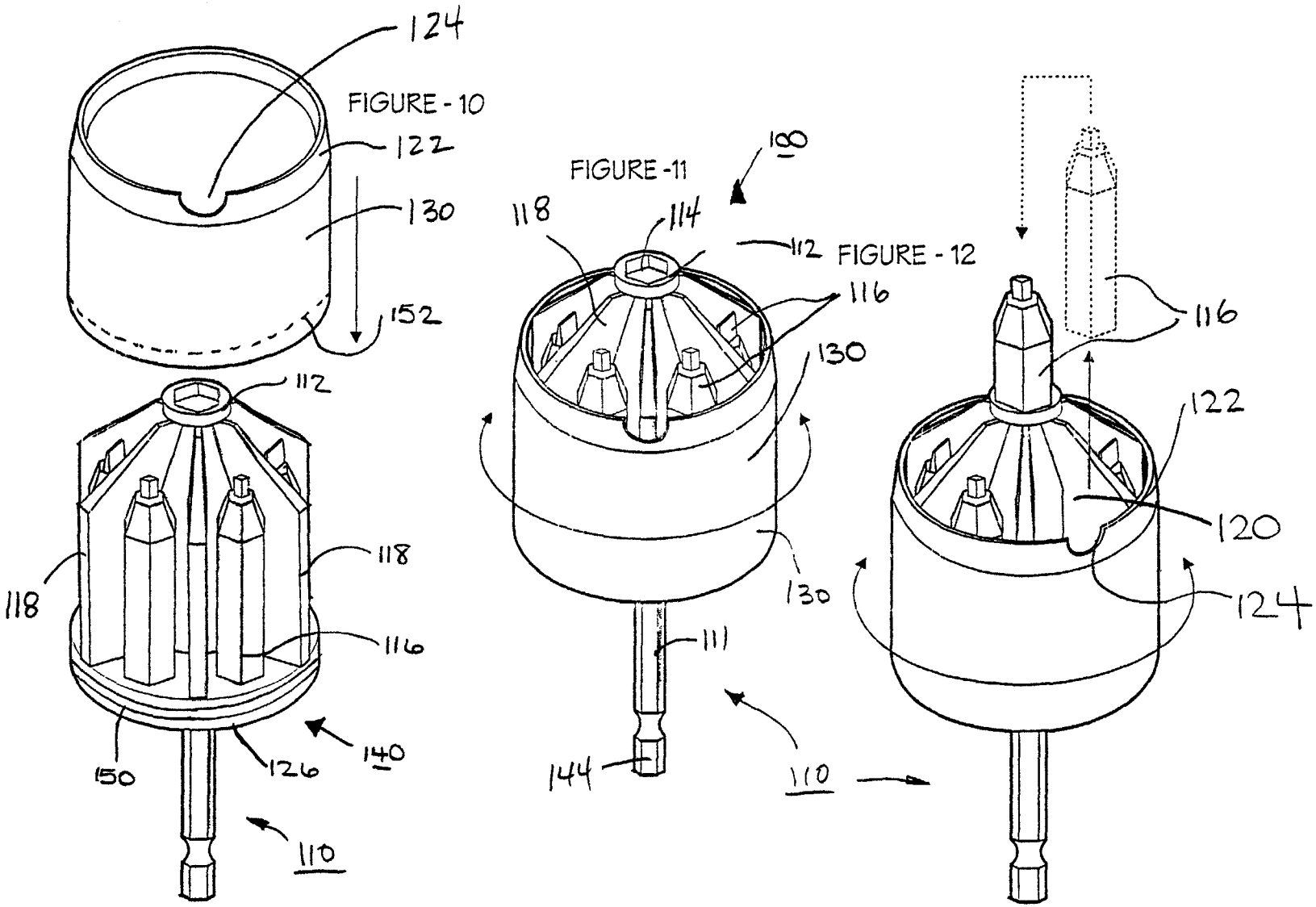
FIG. 10 is a partially exploded perspective view showing the retainer removed from the bit holder.
FIG. 11 is a upright perspective view of the bit holder showing the tool bits nested in their bit compartments.
FIG. 12 is a upright perspective view showing one tool bit inserted in the socket and in shadow the tool bit being removed from an empty bit compartment.
Figure 13:
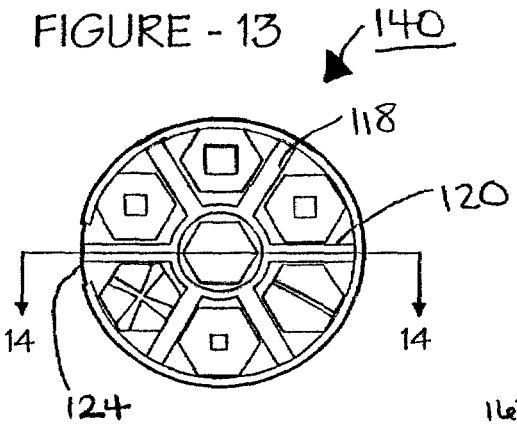
FIG. 13 is a top plan view of the bit holder.
Figure 14:
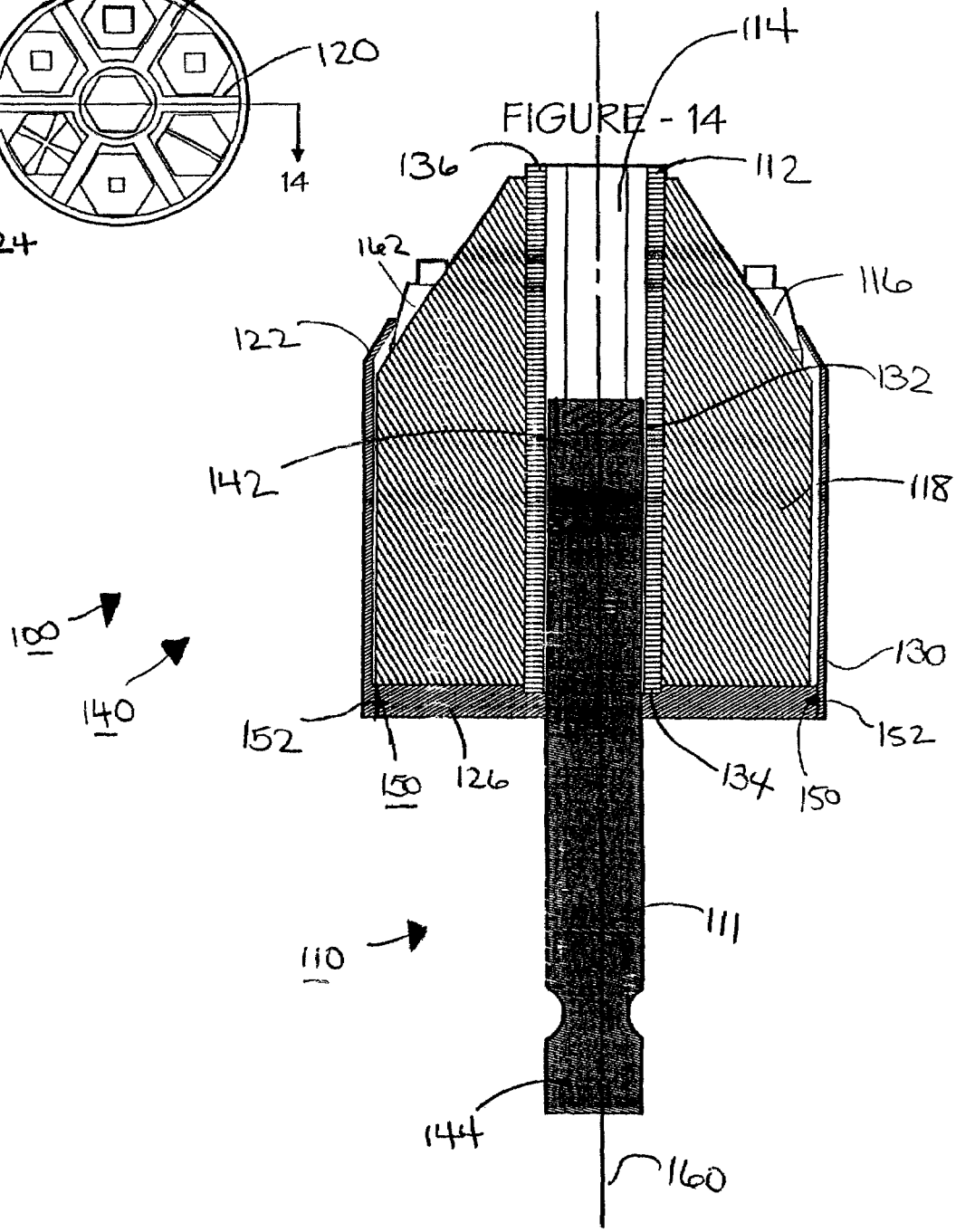
FIG. 14 is a cross-sectional view of the bit holder taken along lines 14—14 in FIG. 13.

Referring to FIGS. 11 and 14 in particular, the present invention of bit holder shown generally as 100 and includes the following components: shaft 110 having a hex portion 111 and a socket portion 112, and a magnet 132, a socket 114, a frame work 140 including base 126, dividers 118 which define bit compartments 120 and a retainer 130 which rotates about shaft bottom 134. Retainer 130 includes a retaining portion 122 and tool bits 116 are housed within bit compartments 120.

Preferably hex driver 110 and hallow shaft 112 are metal components which either can be intragally formed out of one piece of metal and/or are rigidly mounted together as shown in FIG. 14. Which ever construction of hex driver 110 combined with hollow shaft 112 is selected, the end results must ensure that when torque or rotational forces are applied to hex driver 110, hollow shaft 112 is rigidly secured enough to hex driver 110 in order to transmit the torque from hex driver 110 to hollow shaft 112.

Figures 1, 2, 3, 4, 5, 6, 7, 8, 9:
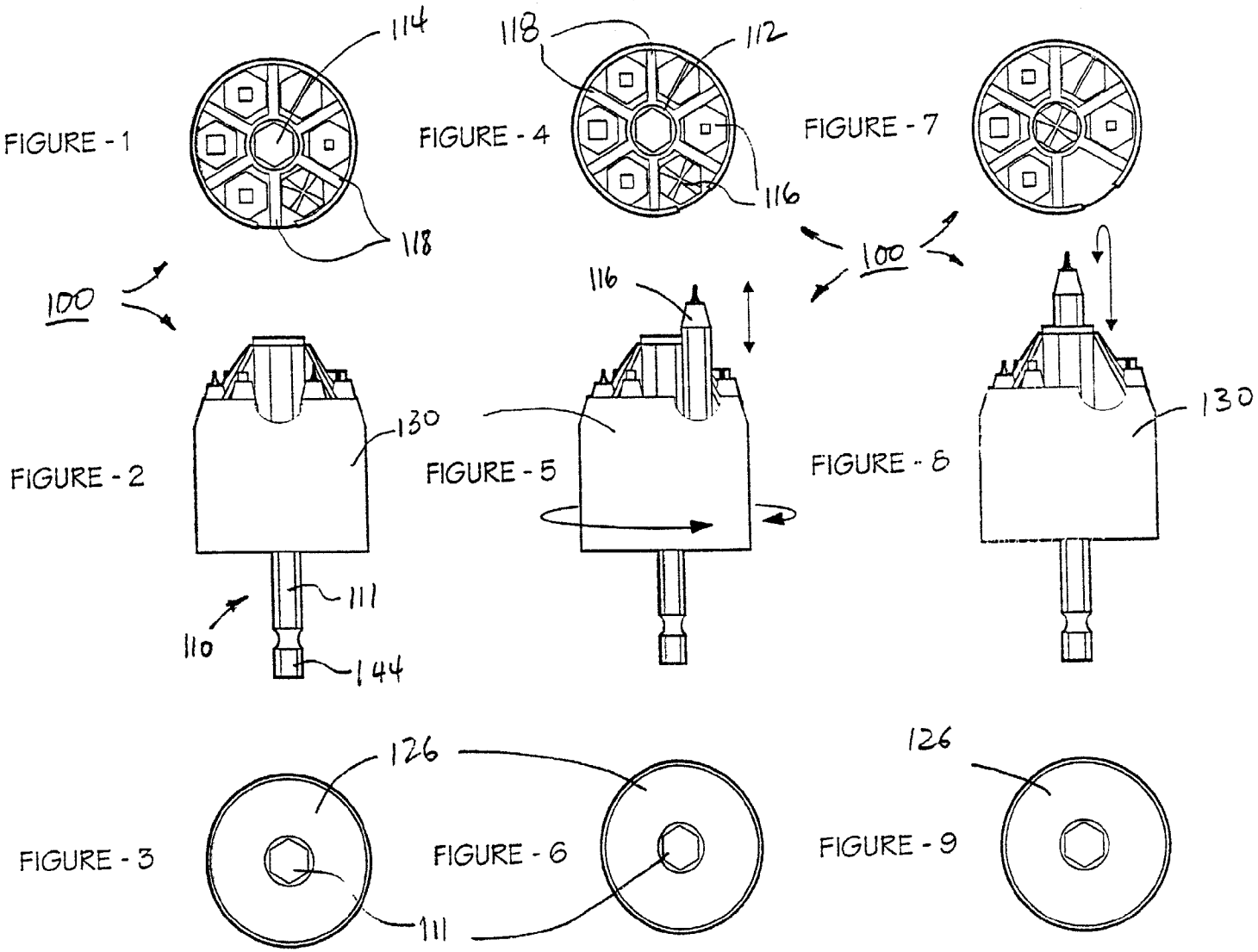
FIG. 1 is a top plan view of the bit holder.
FIG. 2 is a side plan view of the bit holder.
FIG. 3 is a bottom plan view of the bit holder.
FIG. 4 is a top plan view of the bit holder.
FIG. 5 is a side plan view of the bit holder.
FIG. 6 is a bottom plan view of the bit holder.
FIG. 7 is a top plan view of the bit holder.
FIG. 8 is a side plan view of the bit holder.
FIG. 9 is a bottom plan view of the bit holder.

Magnet 132 is imbedded into driver top 142 as shown in FIG. 1 and FIG. 14 and normally there is an interference fit wherein magnet 132 is pressed into a aperture formed in driver top 142. The purpose of magnet 132 is to hold a tool bit 116 into socket 114 and prevent it from falling out of socket 114.

Preferably hex driver 110 is hexagonally shaped of the standard ¼ inch hexagonal driver found on the market place, however it can be dimensioned to other sizes depending upon the application. Similarly socket 114 is a female hexagonal socket adapted to receive hexagonally shaped tool bits 116 having standard dimensions of approximately ¼ inch measured from face to face.

Connected and mounted to the combination of hollow shaft 112 and hex driver 110 is frame work 140 as best shown in FIG. 10 which consists of base 126 and dividers 118. In practice, dividers 118 and base 126 are preferably made by plastic injection moulding, plastic around hex driver 110 and hollow shaft 112.

Once frame work 140 is in place, retainer 130 is placed over bit holder 100 as shown in FIG. 10 whereby a female groove 150 in the outer diameter of base 126 cooperates with male ridge 152 found in the inner diameter of retainer 130, thereby locking retainer 30 onto base 126. It will be apparent to those skilled in the art that many other methods can be used to attach retainer 130 to base 126. The example shown is one of many that can be used to effectively mount retainer 130 onto base 126.

With retainer 130 mounted onto base 126 in this manner, enables retainer 130 to be rotated about a longitudinal axis 160 shown in FIG. 14.

Retainer 130 has a retaining portion 122 which tapers inwardly towards tool bits 116 either impinging upon or coming very close to the tapered shoulders of 162 of tool bits 116 thereby ensuring that tool bits 116 remain within a bit compartment 120.

It will be apparent to those skilled in the art that the retainer 130 can take on various mechanical arrangements not necessarily shown in the diagrams herein. For example the retainer portion 122 may be separate and distinct from the retainer 130. For example a simple rotatable ring having an opening 124 not connected to retainer 130 is possible.

As shown retainer 130 together with frame work 140 defines 6 distinct bit compartments 120 for housing of tool bits 116. There is no reason why this number could be increased or decreased depending upon the final size required of bit holder 100 and also depending upon the total number of tool bits 116 desired to be housed within bit holder 100.

Retaining portion 122 of retainer 130 also has a cut out or retainer opening 124 which can be aligned with a particular bit compartment 120 thereby aligning it with a particular tool bit 116.

In Use

Figure 15:
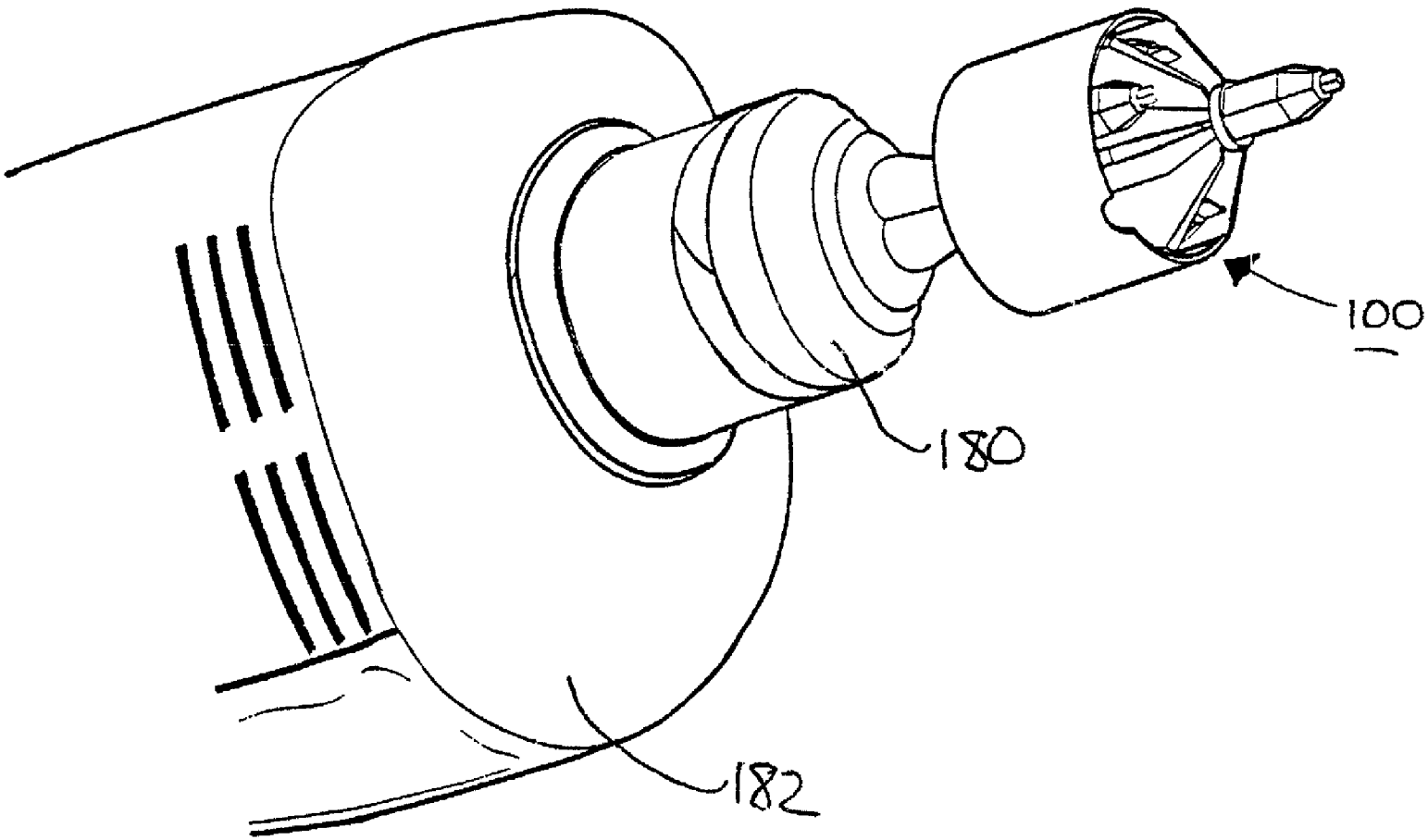
FIG. 15 is a schematic perspective view of the bit holder shown mounted in a drill chuck of a drill.
Figure 18:
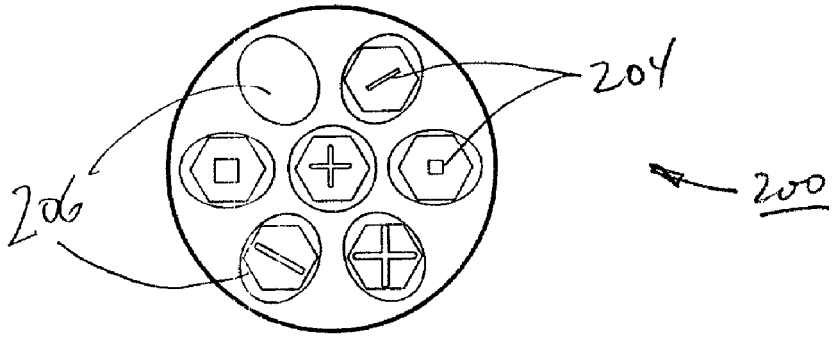
FIG. 18 is a top plan view of the bit holder shown in FIG. 16.
Figure 19:
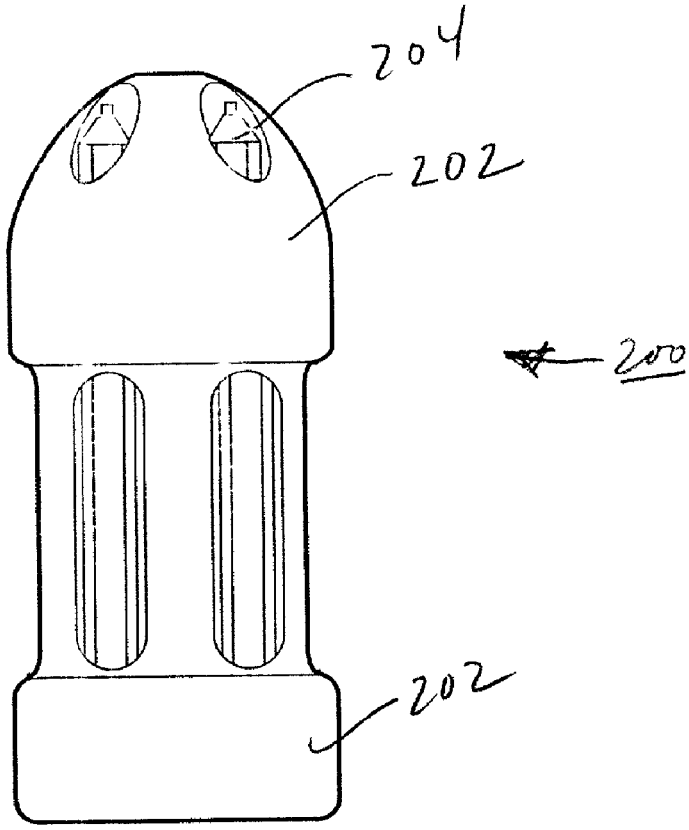
FIG. 19 is a side elevational view of the bit holder shown in FIG. 16.
Figure 20:
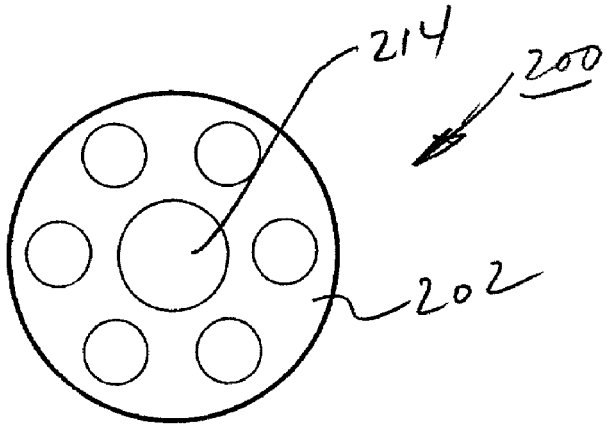
FIG. 20 is a bottom plan view of the bit holder shown in FIG. 16.
Figure 21:
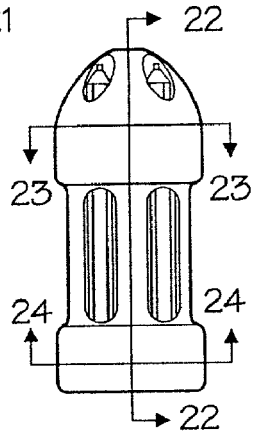
FIG. 21 is a side elevational view of the bit holder shown in FIG. 16.
Figure 22:
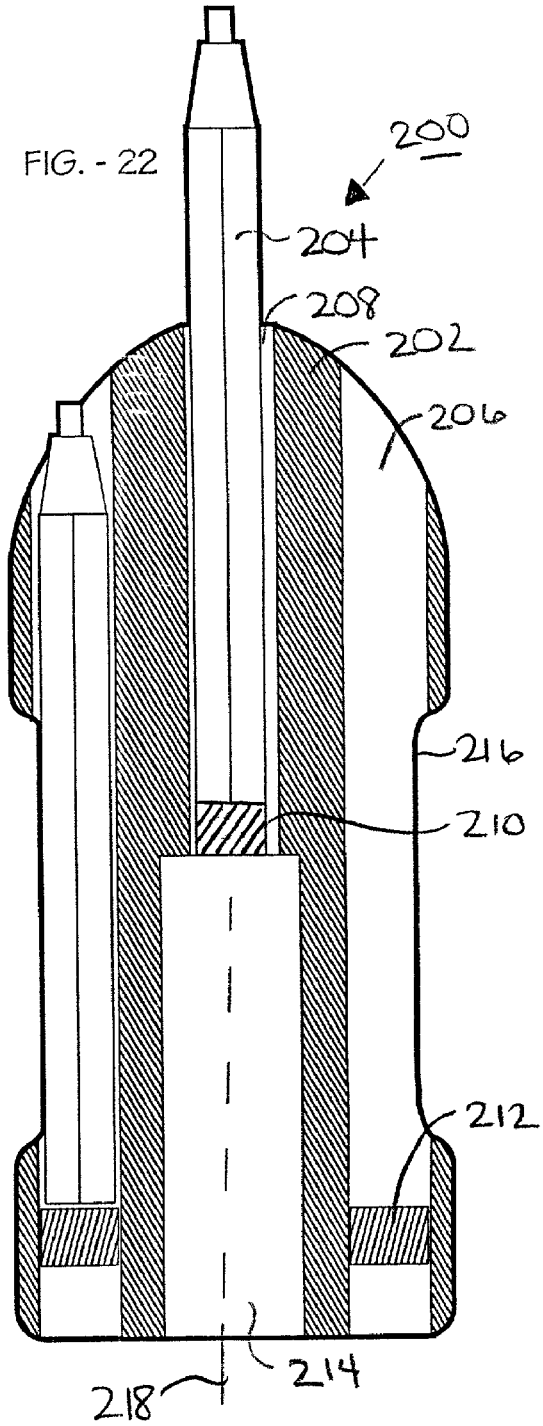
FIG. 22 is a cross sectional view taken along lines 22—22 of FIG. 21.
Figure 23:
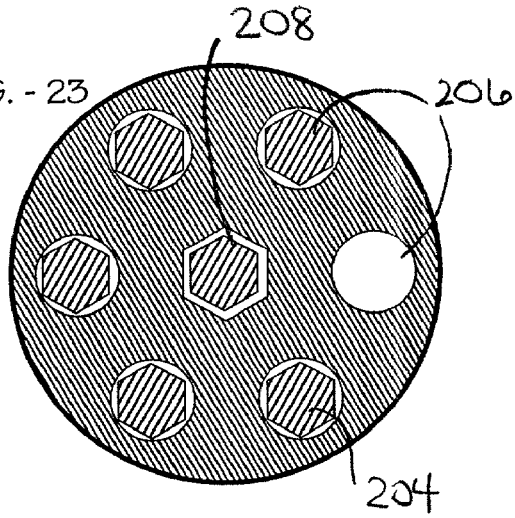
FIG. 23 is a cross sectional view taken along lines 23 shown in FIG. 21.
Figure 24:
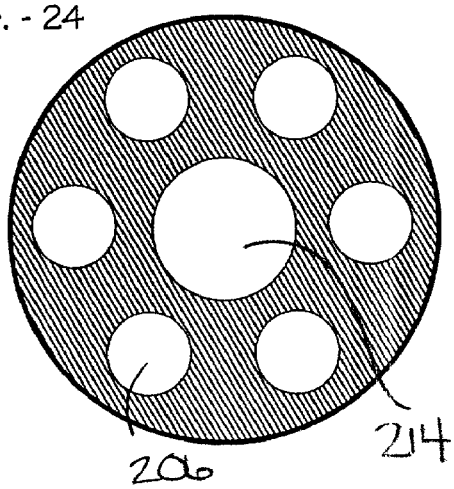
FIG. 24 is a cross sectional view taken along lines 24—24 shown in FIG. 21.

In use driver bottom 144 of bit holder 100 as best shown in FIG. 15 is mounted into a drill chuck 180 and drill 182. With bit holder 100 mounted in drill chuck 180, a particular tool bit 116 is selected from bit holder 100 by rotating retainer 130 such that retainer opening 124 aligns with the desired bit compartment 20 housing the desired tool bit 116. Retainer opening 124 is so dimensioned as to allow removal of tool bit 116 from its bit compartment 120 thereby positioning tool bit 116 into socket 114 where it is retained thereby magnet 132.

The balance of tool bits 116 in this case the five not retained in socket 114 are retained in their perspective bit compartments 120 by retaining portion 122 of retainer 130.

With a tool bit 116 mounted in socket 114, drill 182 can now be actuated there by rotating the entire bit holder 100 and the end of tool bit 116 can be gauged with a screw or whatever work piece for utilizing the selected tool bit 116.

When none of the tool bits 116 is desired, the tool bit 116 found within socket 114 is removed back to its respective bit compartment 120 and retainer 130 is rotated such that retainer opening 124 aligns with a divider 118 as shown in FIG. 11, thereby locking all of the tools bits 116 and their respective bit compartments 120.

The advantage of bit holder 100 is that the bits are easily selectable since they are located very close to the drill chuck 180 and the work piece being used. It will further be appreciated that a particular tool bit 116 can be easily and quickly selected and placed back into its respective bit compartment 120 such that the tool bits 116 do not become lost.

Further, it will appreciated by those skilled in the arts that various lengths of tool bits 116 can be used depending upon the dimensions of bit holder 100 in addition to the tool bits of the type shown, any standard type tool bit can be used, including drill bits and/or other bits as long as they are adapted to be received cooperatively within socket 114.

As drill chuck 180 rotates thereby rotating hex driver 110, there in turn rotating hollow shaft 112, which there in turn rotates the tool bit 116 found within socket 114, the tool bit within socket 114 can impart torque and/or turning forces onto whatever work piece it is applied to.

It will be apparent to those skilled in the art that the above described mechanism for the selection of tool bits can also be adapted for use as a manual driver. For manual drivers driver bottom 144 instead of being mounted to chuck 180 would be securely mounted to a handle not shown in the drawings. The handle would be designed to fit comfortably in a hand. Bit holder 100 would be rotated by the manual turning of a handle which rigidly connected to bit holder 100.

Presently Preferred Embodiment FIGS. 16 Through 37

Referring now to a presently preferred embodiment of the invention which is depicted in FIGS. 17 through 37. The presently preferred invention, a bit holder shown generally as 200 in FIG. 22 includes the following major components, namely housing 202, tools bits 204, six bit compartments defined in housing 202, nested symmetrically about a longitudinal axis 218 of housing 202, a hexagonal socket defined centrally along longitudinal axis 218 within housing 202 for receiving tools bits 204 therein, magnets 210 located at the base of hex socket 208 and magnets 212 located near the bottom of bit compartments 206 for magnetically retaining tools bits 204 within either bit compartment 206 or hex socket 208, a threaded aperture in the rear portion of housing 202 and fix compartment openings 216 corresponding to bit compartment 206 for the purpose of enabling the user to slide a tool bit tool four out of its bit compartment 206 by applying finger pressure.

In Use

Figures 25, 26, 27:
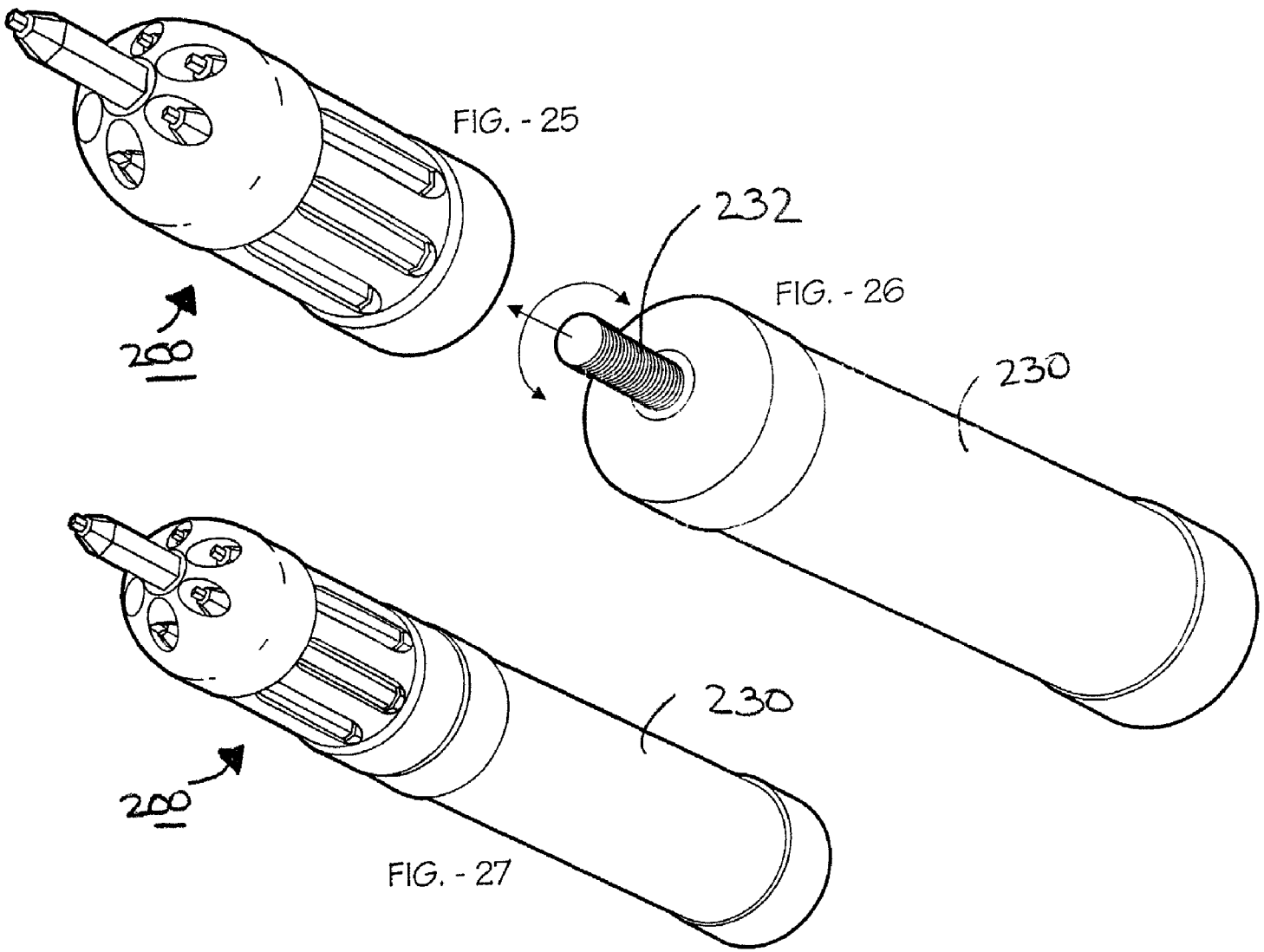
FIG. 25 is an assembly drawing shown the presently preferred bit holder 200 for mounting onto a handle.
FIG. 26 is a front schematic perspective view of a handle for mounting of bit holder 200 thereon.
FIG. 27 is an assembled schematic perspective front view of bit holder 200 mounted onto handle 230.
Figure 28:
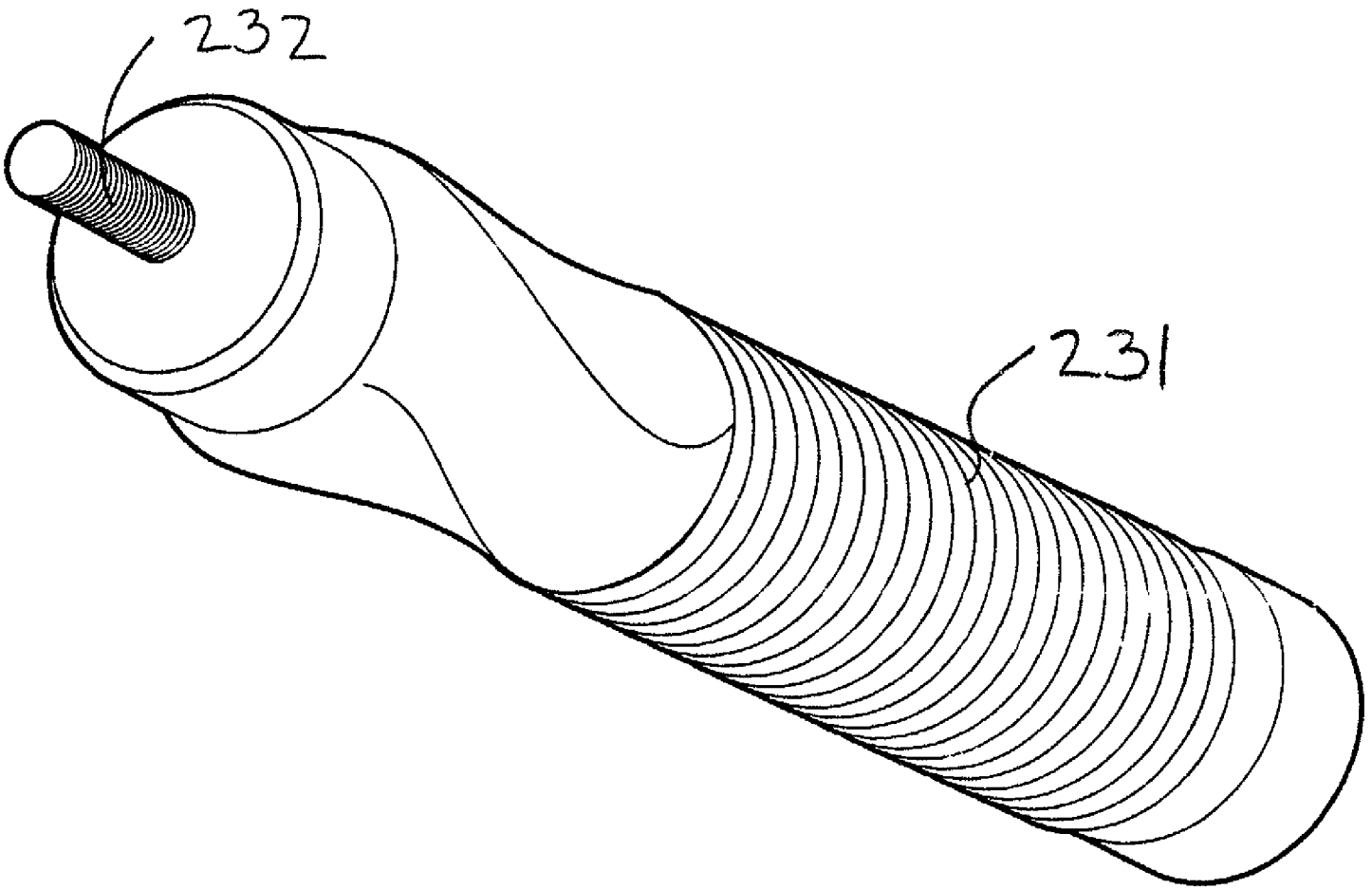
FIG. 28 is an alternate embodiment of the handle shown in FIG. 26.
Figures 29, 30, 31, 32:
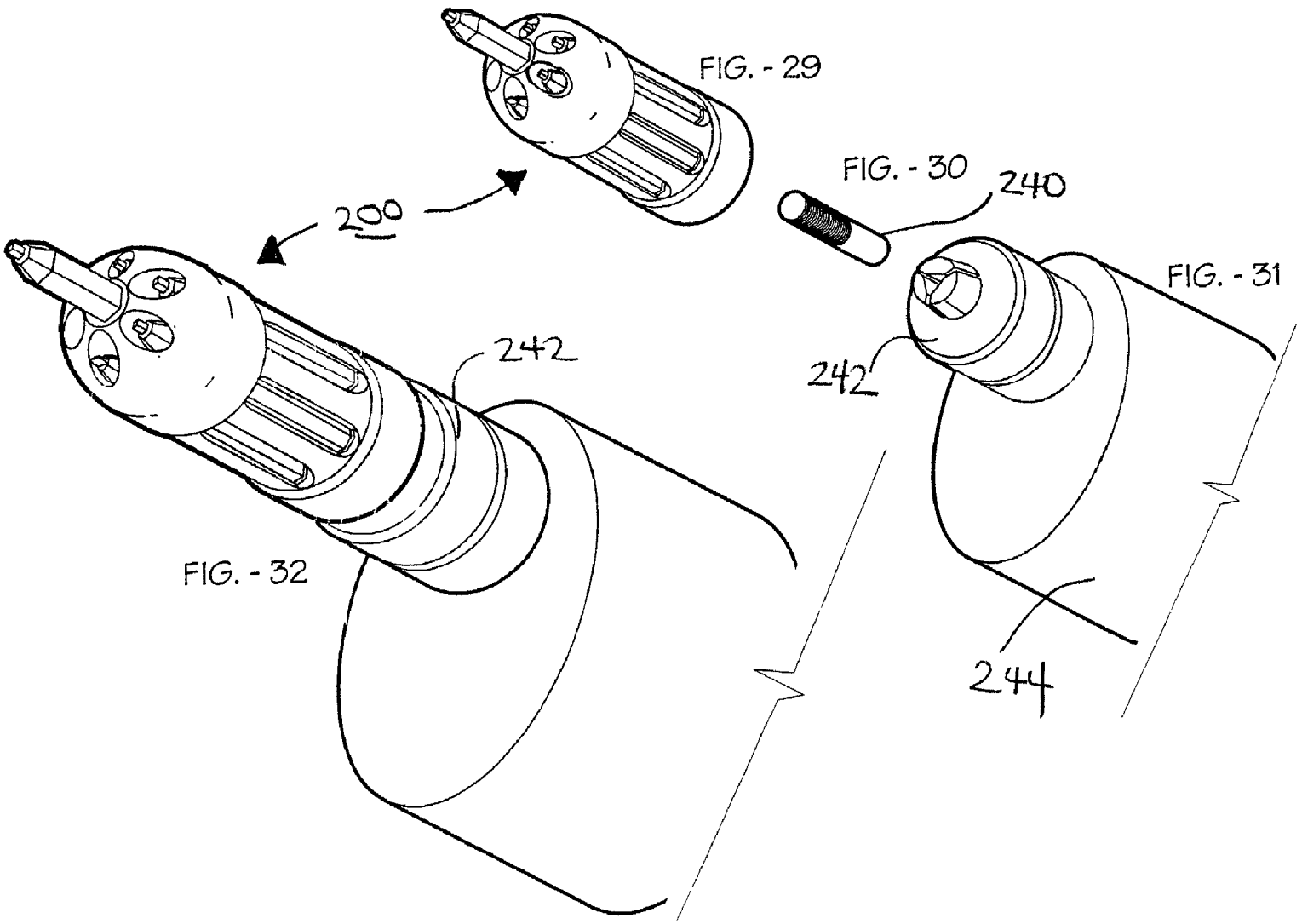
FIG. 29 is a schematic front perspective view of the bit holder shown being assembled into the chuck of a drill.
FIG. 30 is the adapter shaft required for mounting bit holder onto a drill chuck.
FIG. 31 is a partial front schematic perspective view of a drill chuck together with a portion of the drill.
FIG. 32 is an assembled view of the bit holder mounted onto a drill chuck of a drill.

Bit holder 200 can be used as a manual screw driver by affixing it to a handle 230 shown in FIG. 26 via threaded shaft 232 located symmetrically along longitudinal axis 218. Threaded shaft 232 is threadably received within threaded aperture 214 of bit holder 200 thereby securely joining bit holder 200 to handle 230 as shown in the assembled condition in FIG. 27. This configuration, bit holder 200 can be used as a manual bit driver and tools bits 204 can be selected by slideably removing tool bit 204 out of its bit compartment 206 by using finger pressure to slide the tool bit 204 out of bit compartment 206 and manually positioning it slideably into hex socket 208 until magnet 210 holds tool bit 204 within bit socket 208. In this manner a total of seven tool bits can be held magnetically in place by bit holder 200 and each bit can be selected according to need.

Referring now to FIGS. 29, 30, 31 and 32 by using adapter shaft 240 which is threaded on one end to be threadably received within threaded aperture 214 of tool bit 204 and is smooth and/or hexagonally shaped on the other end to be received in drill chuck 242 of a standard portable drill 244 as depicted. By using adapter shaft 240, bit holder 200 can be mounted into a drill chuck 242 and thereby bit holder 200 can be used as a bit driver on a drill 244.

Figures 33, 34, 35, 36, 37:
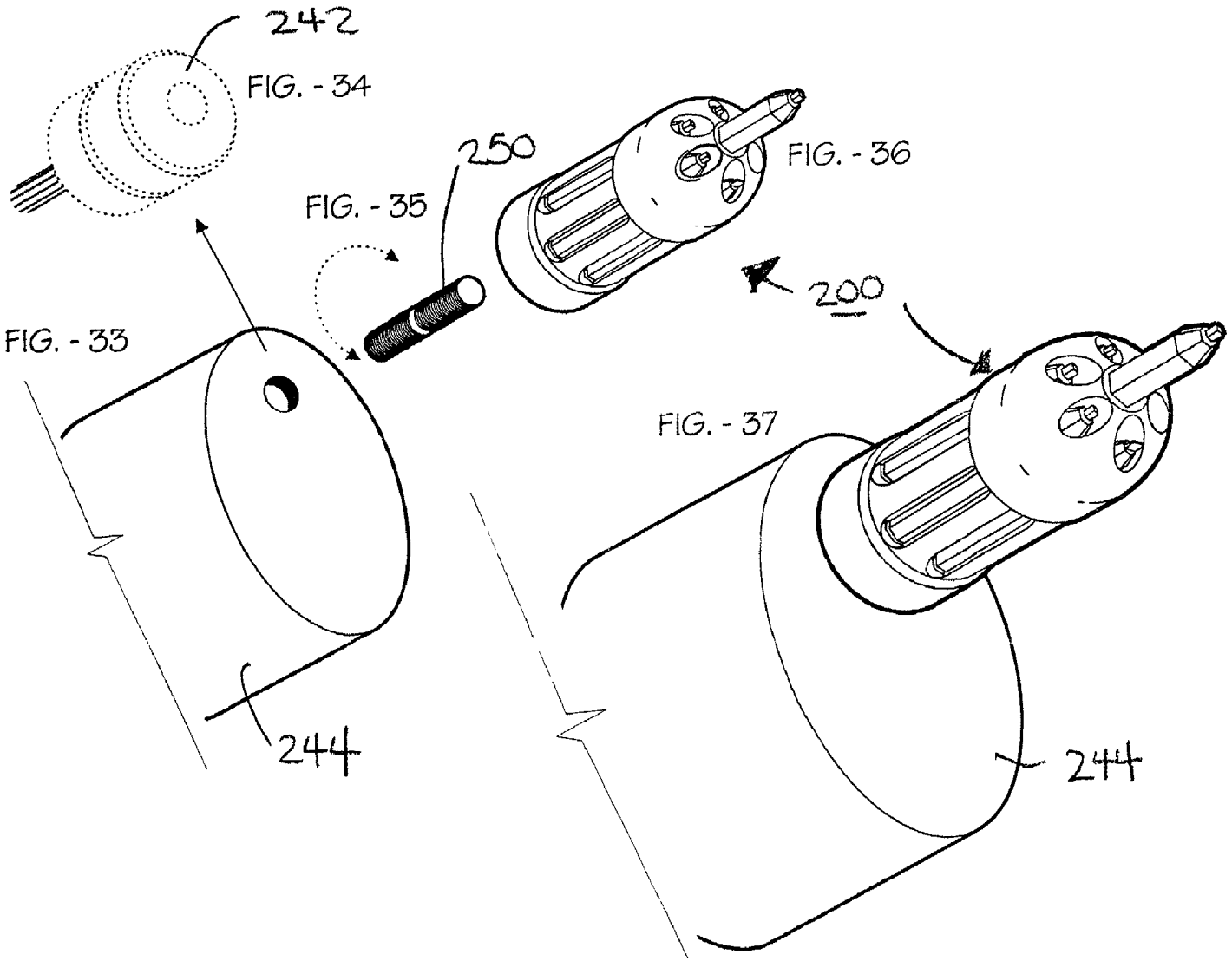
FIG. 34 is a schematic ghost outline of a drill chuck removed from a drill.
FIG. 35 is a schematic perspective view of a threaded shaft joining a drill with a drill chuck.
FIG. 36 is a schematic front perspective view of the bit holder.
FIG. 37 is an assembly drawing showing the bit holder replacing a conventional drill chuck on a drill.

Referring now to FIGS. 33, 34, 35 and 37, most commercially available drills 244 have a removable drill chuck 242 as shown in FIG. 34. This drill chuck will either leave behind a threaded shaft 250 which is removable and/or projects out of the end of drill 244 where drill chuck 242 was previously mounted. This threaded end is normally either ⅜ fine thread or ½ fine thread and threaded aperture 214 is adapted in size and threading to be threadably received onto threaded shaft 250 which is either integrally part of drill 244 or can be sold as an adapter piece to allow one to mount bit holder 200 directly onto drill 244. In this manner, bit holder 200 essentially replaces drill chuck 242, thereby reducing the weight and the cantilever action of bit holder 200 and minimizes the distance that bit holder 200 projects away from drill 244. This makes for a much more compact installation than that shown in FIG. 32, reduces weight and certainly if of interest to contractors who are constantly using bit drivers.

Alternate Presently Preferred Embodiment

Figure 38:
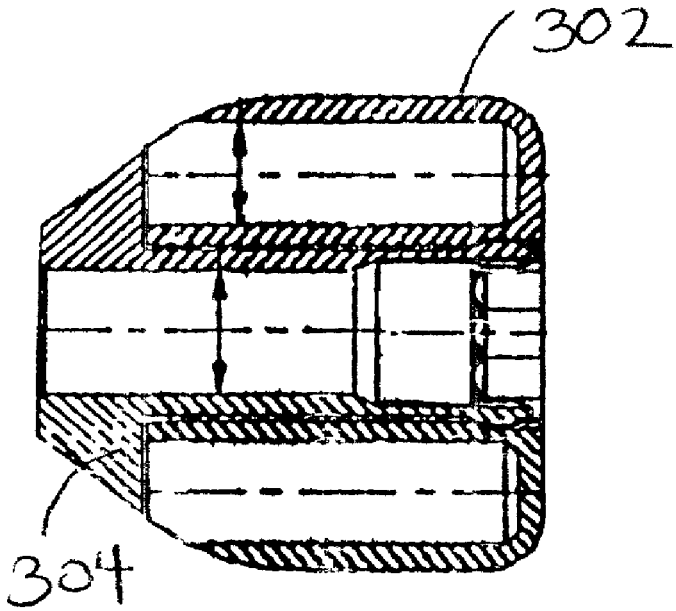
FIG. 38 is a cross sectional view of an alternative embodiment of the present invention, namely bit holder 300.
Figure 38:
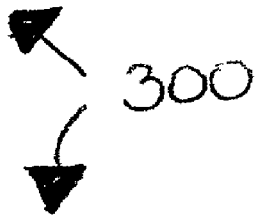
Figure 39:
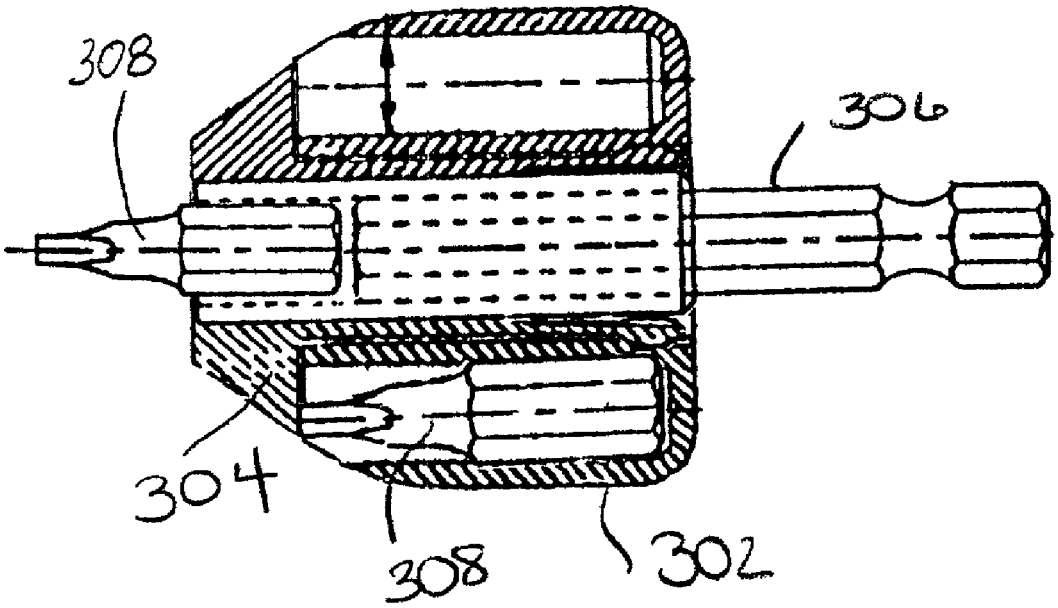
FIG. 39 is a cross sectional view of bit holder 300 showing shaft 306 in place.
Figure 40:
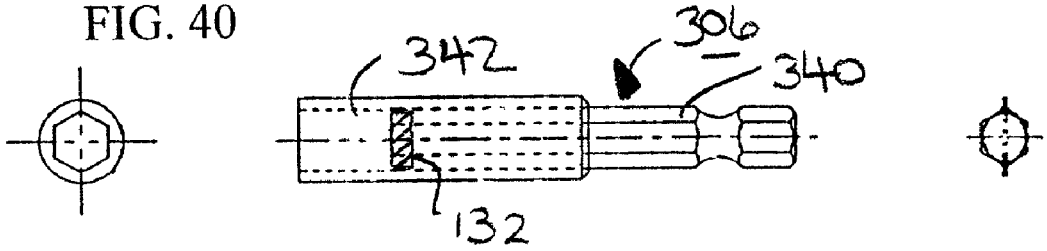
FIG. 40 is a front, side and bottom plan view of a shaft which is part of bit holder
Figure 41:
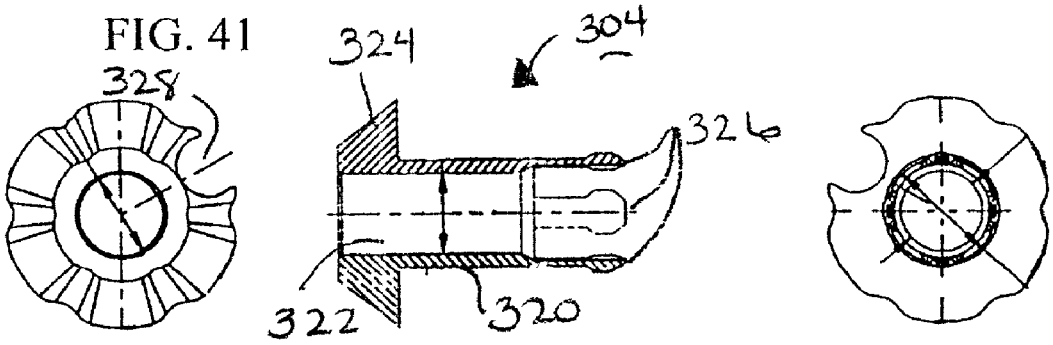
FIG. 41 is a top, side and rear plan view of a sleeve which is part of bit holder 300.
Figure 42:
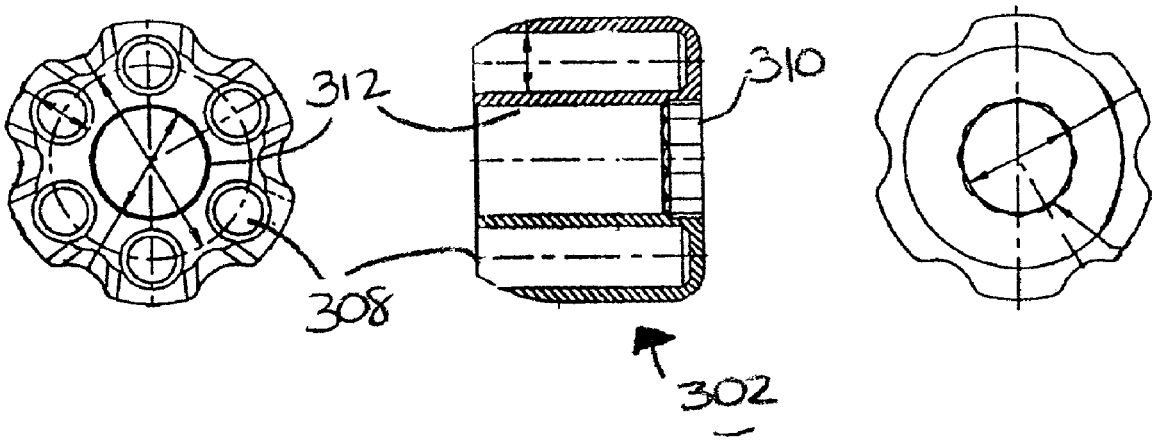
FIG. 42 is a front, side and rear plan view of a housing which is part of bit holder 300.
Figure 43:
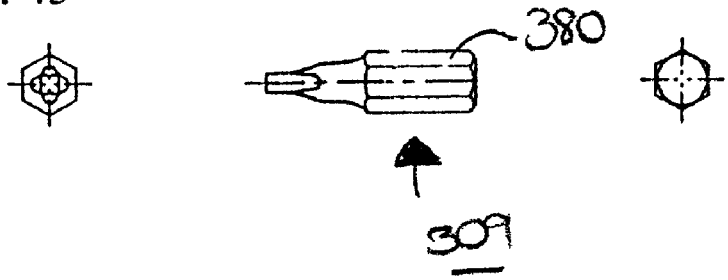
FIG. 43 is a front, side and rear plan view of a tool bit which is part of bit holder 300.
Figure 44:
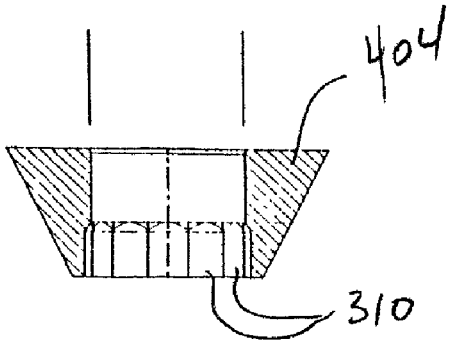
FIG. 44 is a cross sectional view of a sleeve.
Figure 45:
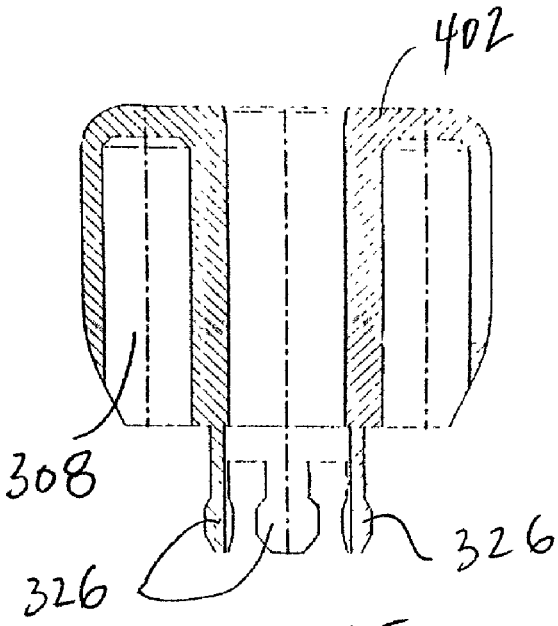
FIG. 45 is a cross section view through a housing.
Figure 46:
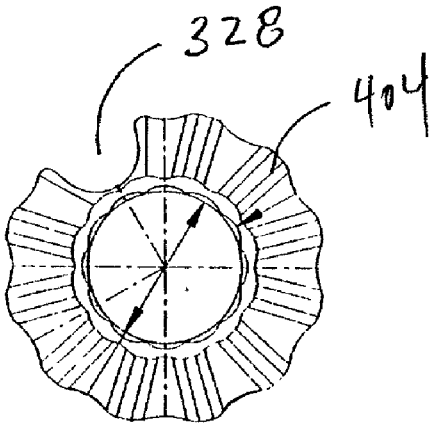
FIG. 46 is a front elevational view of the sleeve shown in FIG. 44.
Figure 47:
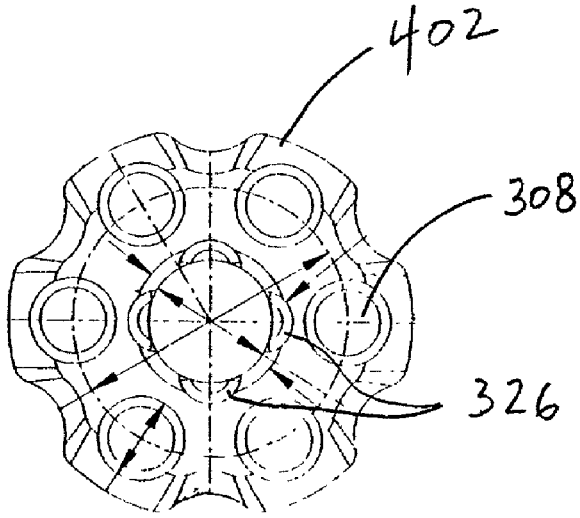
FIG. 47 is a front elevational view of the housing shown in FIG. 45.

An alternate presently preferred embodiment is depicted in FIG. 38 and on showing the present invention a bit holder 300 which includes the following major components housing 302, a sleave 304, shaft 305, tool bit 309 all of which are assembled together as shown as FIG. 39.

Referring first of all to housing 302 which is preferably injection molded in plastic, it includes the following major components, namely six bit compartments 308 and inter diameter which mates onto out diameter 320 of sleave 304 and a series of twelve groves 310 and the rear portion of housing 302 which comparatively engage with tongues 326 found in sleave 304.

Sleave 304 includes the following major components, retainer portion 324, inner diameter 322 for fitting onto socket portion 342 of shaft 306, outer diameter 320 which acts as a baring surface on which housing 302 rotates and tongue 326 extending rearwardly and cooperatively engaging within grooves 310 of housing 302. Retainer portion 324 further includes an opening 328 through which tool bit 308 may pass through without impediment.

Shaft 306 includes the major elements hex portion 340 which is a hexagonally shaped shaft with a socket portion 342 which is normally metallic in material having a magnet 132 wherein said socket portion 342 is dimensioned to receive the hexagonal shaft of tool bit 308.

Assembly and in Use

The components described above are firstly assembled as follows. The inner diameter 312 of housing 302 fits slideably over the outer diameter 320 of sleave 304 and are slid over until tongue 326 engage with grooves 310 found within housing 302. This assembly of housing 302 and sleave 304 is shown in FIG. 38. This sub assembling is then press fit onto the socket portion 342 of shaft 306 and the inner diameter 322 of sleave 304 is dimensioned to fit interferingly with the outer diameter of socket portion 342, such that when sleave 304 together with housing 302 are press fit onto socket portion 342 of shaft 306 it is rigidly held in place on shaft 306.

The inner diameter 312 of housing 302 is dimensioned to slideably and rotatably fit over outer diameter 320 of sleave 304 such that housing 302 together with tool bit 309 located within bit compartment 308 can rotate around sleave 304 which is stationary and rigidly positioned onto socket portion 342 of shaft 306. Groove 310 cooperatively engaging with tongues 326 of sleave 304 provide resistance to turning of housing 302 which can be overcome by hand pressure, namely manually turning housing 302 and rotating it around sleave 304 such that a clicking action occurs as it is moved from one groove 310 to the next. There are essentially double as many grooves 310 as there are bit compartment 308, such that if there are six bit compartments as shown there are twelve grooves 310 and therefore there are twelve positions to which housing 302 can be moved to. In six of those positions, opening 328 coincides with the opening on one end of bit compartment 308, thereby allowing a tool bits 309 to freely be removed from bit compartment 308 adjacent to opening 328. By moving the housing 302 one click further, this locks all of the bits within their compartments and none of the tools bits 309 can be removed from bit compartment 308 since they are being blocked off by retainer portion 324 of sleave 304.

A tool bit 309 is selected from one of its bit compartment 308 as described above and placed in the socket portion 342 of shaft 306 and held in place by magnet 132. As previously shown in FIG. 15, the hex portion 340 of bit holder can be mounted into a chuck of a drill as shown in FIG. 15 in identical fashion as bit holder 100 is. In this manner, bit holder 300 can be used to quickly and effectively select up to seven bits which can be neatly held within bit holder 300 and organized in such a fashion that they are not lost.

Presently Preferred Alternate Embodiment of a Bit Holder

Figure 48:
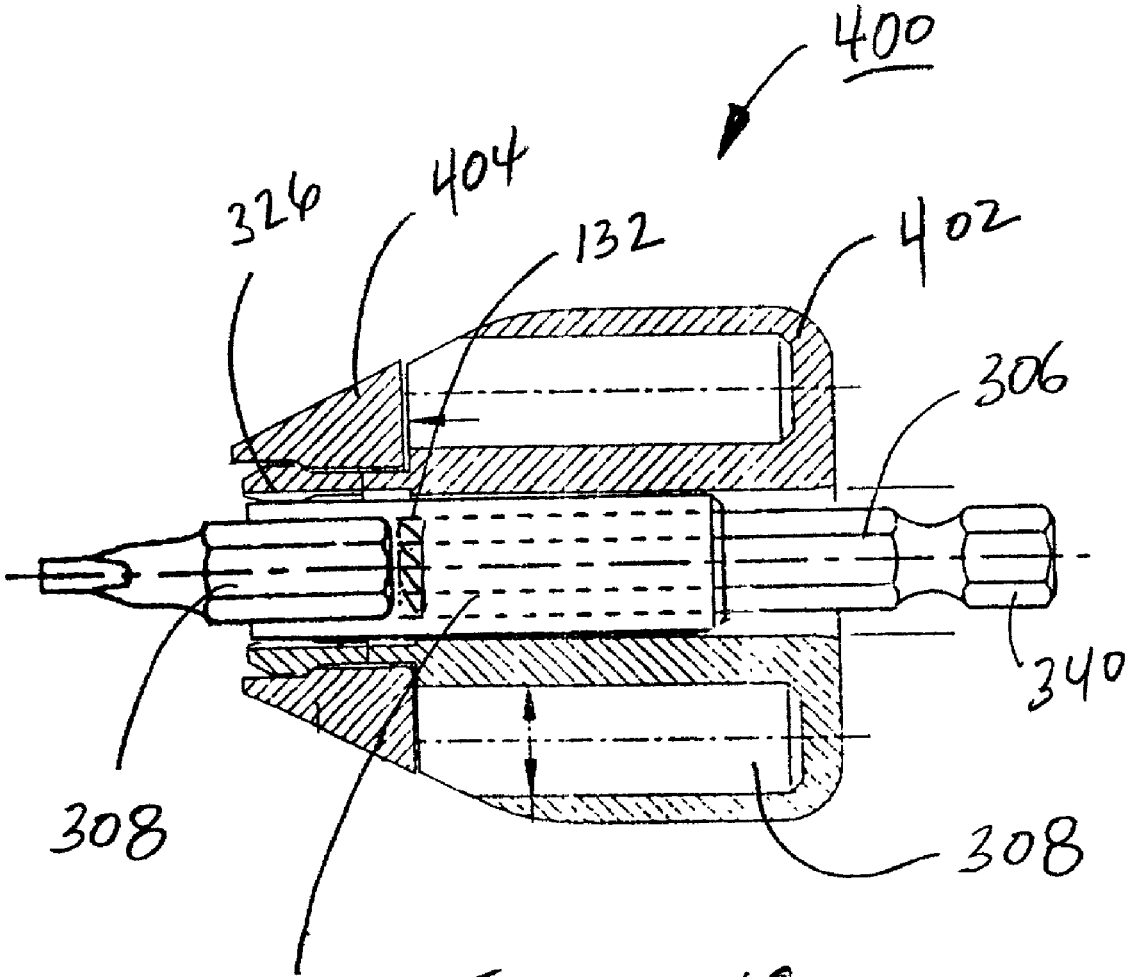
FIG. 48 is an alternate embodiment of a bit holder shown in the assembled state from the components depicted in FIGS. 44 through 47, wherein bit holder 400 is a cross sectional view of the bit holder with a shaft in place including a housing sleeve and bit.

FIGS. 44 through 48 inclusive show an alternate embodiment and a bit holder shown generally as 400 in the assembled state in FIG. 48. Bit holder 400 is very similar to bit holder 300, the major difference being that the tongue and grooves which are located nearest the back of the body 302 for bit holder 300 have been moved to the front of the body 402 for bit holder 400. In order to have the tongue 326 and grooves 310 moved to the front of body 402, sleeve 404 is modified to have the grooves 310 defined therein and the tongues 326 are placed on the front of body 402 rather than on the rear of sleeve 304 as in the previous embodiment. In all other aspects the presently preferred embodiment of bit holder 400 operates and functions in an identical and analogous manner to bit holder 300 with the exception that rather than rotating body 302, sleeve 404 is rotated relative to body 402 which is stationarily mounted onto shaft 306 and sleeve 404 rotates about the tongues 326 and about shaft 306 as shown in FIGS. 44 through 48. In the previous embodiment bit holder housing 302 was rotatably mounted onto sleeve 304 whereas in the presently preferred embodiment, bit holder housing 402 is securely mounted onto the socket portion 342 of shaft 306 and sleeve 404 is mounted over tongues 326 which are now part of housing 402.

In this manner it would apparent to those skilled in the art that is irrelevant whether or not sleeve 404 or body 402 are rotating, but what is important is that either the body or the sleeve are rotating relative to each other and that the tongue 326 and groove 310 mechanism used can be placed either in the forward portion or the rearward portion of bit holder 400 or 300 as shown in the Figures. For that matter the tongue and groove mechanism can be mounted in a different location and yet render the same function.

New Matter Entered in this Continuation in Part

Alternate Embodiment

A further embodiment of the bit holder is shown in FIGS. 49 through 59 and is shown generally as combination screw driver 501 which is comprised of the major components, bit holder 500 and handle 570.

Figure 59:
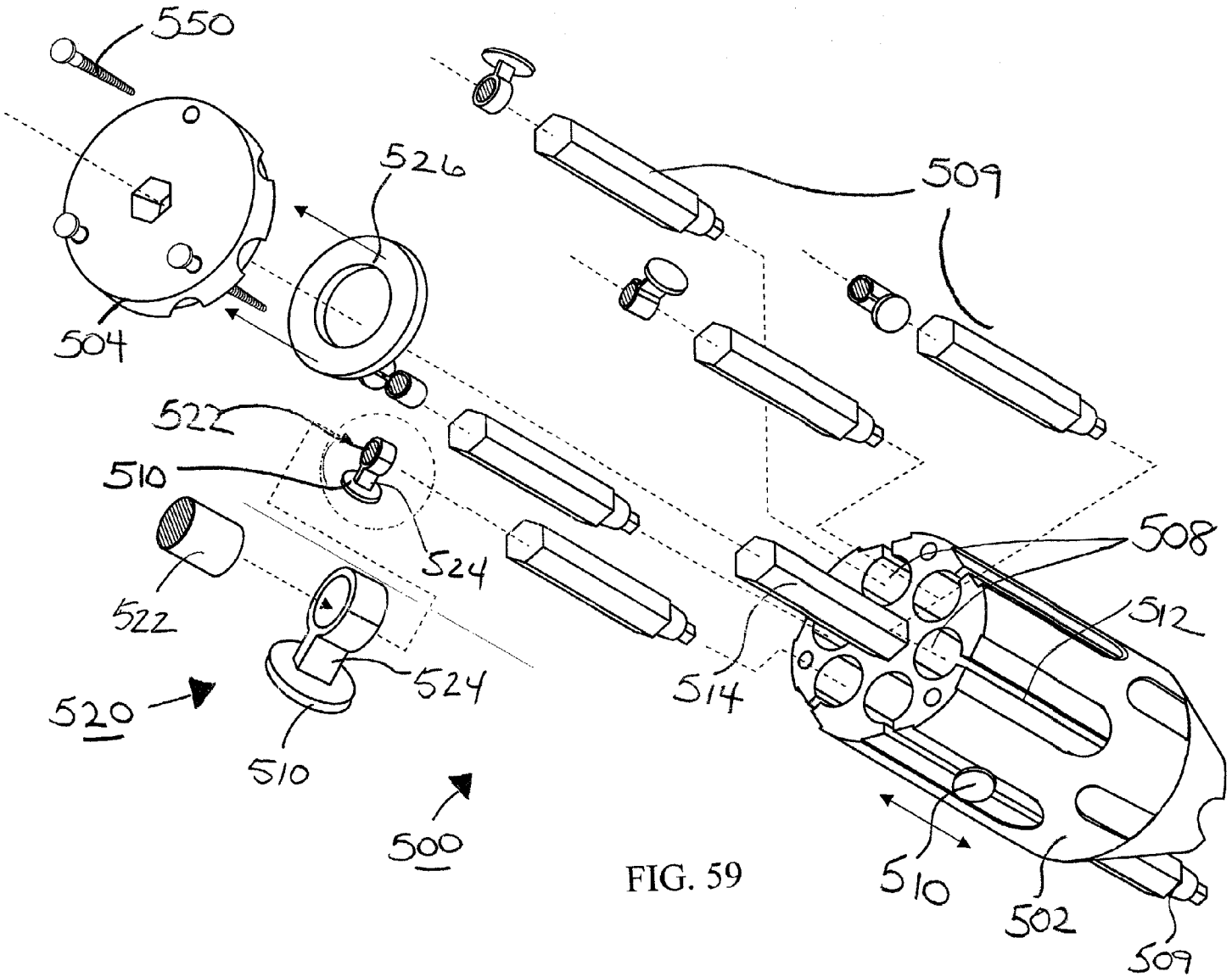
FIG. 59 is a schematic exploded rear perspective view of the bit holder shown in FIG. 50.
Figures 60, 61, 62:
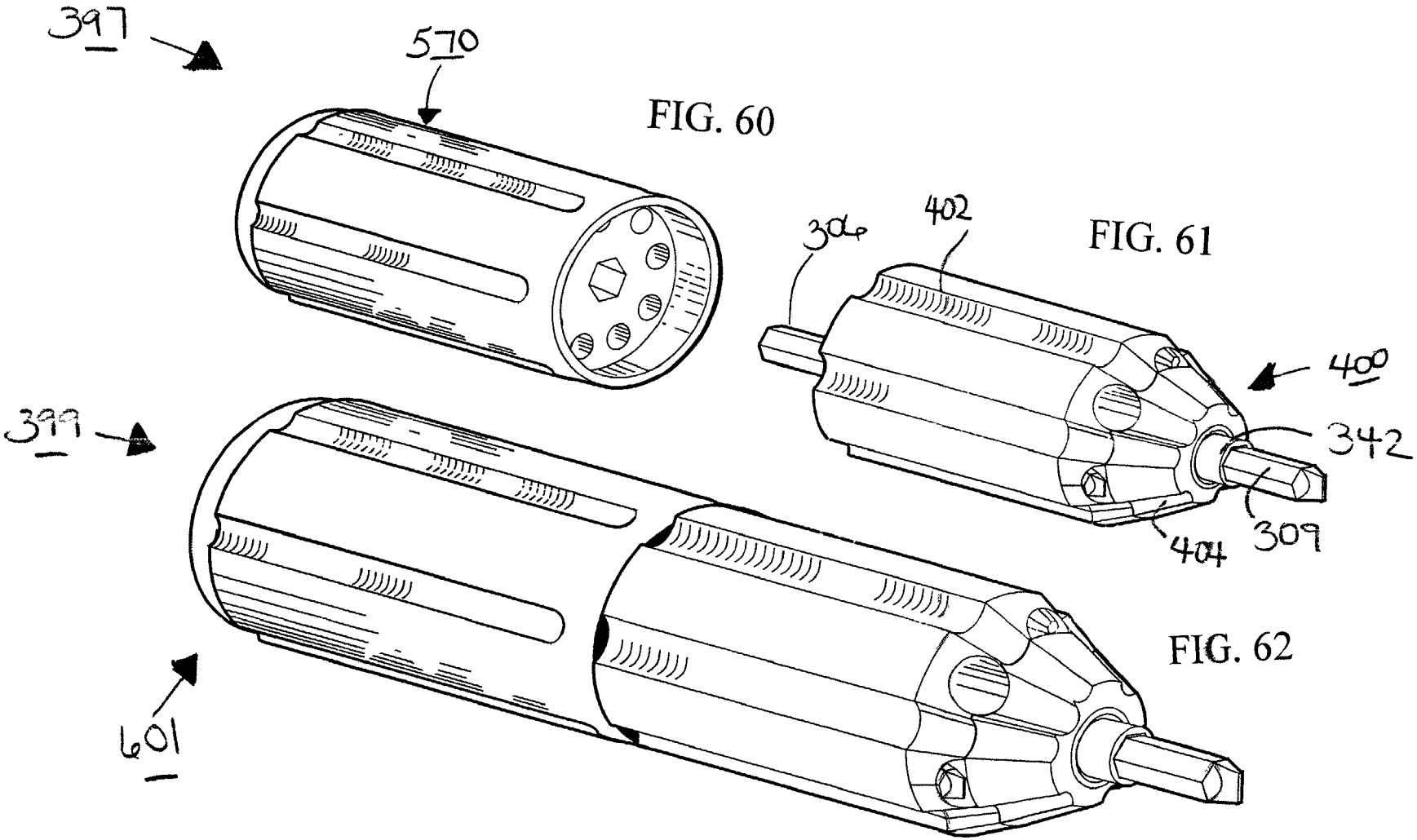
FIG. 60 is a front perspective schematic view of the handle shown in FIG. 50.
FIG. 61 is a front perspective view of a bit holder.
FIG. 62 is a forward schematic view in the attached position of an alternate embodiment of the combination screw driver.

Firstly, we will describe the components of bit holder 500 as best shown in the exploded view depicted in FIG. 59. Bit holder 500 includes the following major components, namely housing 502, end cap 504, socket 506, bit compartments 508, tool bits 509, actuator 520 including the components, knob 510, magnet 522, magnet holder 524, actuator channel 512, washer 526 and fasteners 550.

Housing 502 has defined therein six bit compartments 508 which are dimensioned to receive bits 509 slideably therein. An actuator assembly 520 which includes the components of a magnet 522, a knob 510, a magnet holder 524 is also slideably received within actuator channel 512 at the bottom end of each bit compartment 508. Magnets 522 are attracted magnetically to the metal bits 509 at one end and also attracted magnetically to metal washer 526 at the other end. Housing 502 is preferably made of plastic and/or non-ferrous metals and has defined therein bit compartments 508 as well as slot shaped actuator channels 512 which allow magnet holder 524 to slideably move longitudinally along each actuator channel 512. With all actuators 520 in place and washer 526 in place end cap 504 is fastened onto the rear portion of housing 502 therefore closing off the rear portion of bit holder 500. Shaft 514 is rigidly and permanently attached to housing 502 either by molding it right into housing 502 or attaching it by other means known in the art.

Tool bits 509 are extended and retracted along bit compartment 508 by urging knob 510 which in turn urges actuator assembly 520 which in turn slidably urges bit 509 forwards 531 and backwards 533 within bit compartment 508. Bit 509 is shown in the retracted position 543 with magnet 522 contacting the end of bit 509 and also washer 526. Bit 509 is also shown in the extended position 541 wherein magnet 522 is only contacting the tool bit 509. In the fully extended position not shown, actuator assembly is urged to the extreme forward 531 position along actuator channel 512.

The top portion of housing 502 defines, a socket 506 for receiving slideably therein tool bits 509. Tool bits 509 are retained in socket 506 magnetically by a magnet which is situated in the bottom of socket 506 and not shown in the drawings. Tool bits 509 are loaded into bit compartments 508 from the top portion after end cap 504 is in position and as shown bit holder 500 can hold 6 tool bits within bit compartments 508 and as well a seventh tool bit 509 in socket 506. Socket 506 is preferably hexagonal in shape accommodating a standard shape quarter inch hexagonal tool bit as shown in the diagrams. Any number of bit compartment 508 are possible as are alternate shaped bits 509.

Figure 68:
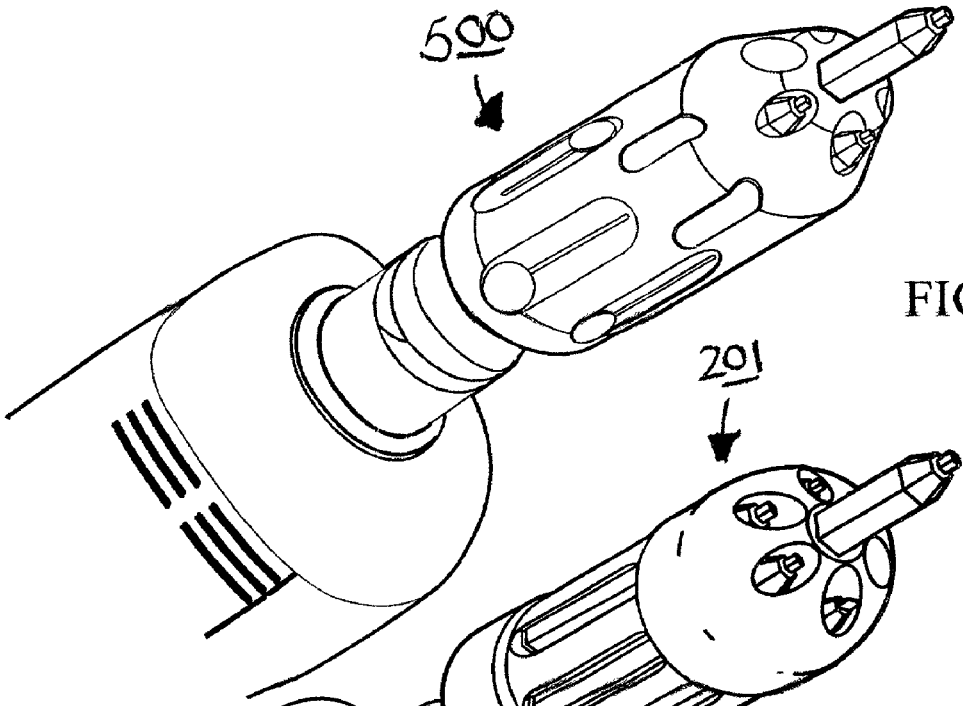
FIG. 68 is a front schematic perspective view of the bit holder depicted in FIG. 50 shown diploid onto a drill chuck.

Referring now to FIG. 68, bit holder 500 is shown mounted onto a drill chuck as depicted in FIG. 68. Shaft 514 is received within drill chuck and clamped into position and in this manner will rotate in unison with the drill chuck.

A tool bit 509 is selected by slideably urging knob 510 along an actuator channel 512 therefore magnetically releasing magnet 522 from washer 526 and urging tool bit 509 out of each bit compartment 508. To reinsert the tool bit 509, it is simply slid into a vacant bit compartment 508, wherein it is magnetically attracted to magnet 522 of actuator 520 which in turn is magnetically attracted to washer 526. In this manner each bit 509 is held magnetically in its respective bit compartment 508 by the magnetic attraction of the magnet 522 with bit 509 together with washer 526. Similarly tool bits 509 can be mounted into socket 506 simply applying finger pressure to release tool bit 509 from the magnetic attraction of the magnet in the bottom of each socket 506 and in this manner tools bits can be placed and removed from socket 506 simply using longitudinal finger pressure onto tool bit 509. When shaft 514 is mounted into a drill chuck, the entire housing 502 with shaft 514 and the bits stored therein all rotate in unison as shaft 514 is rotatably urged by a rotating drill chuck.

I will now describe how handle 570 is constructed and cooperatively adapts together with bit holder 500, thereby creating a combination screw driver 501 as depicted in FIGS. 50, 56, 57 and 58.

Figures 49, 50, 51:
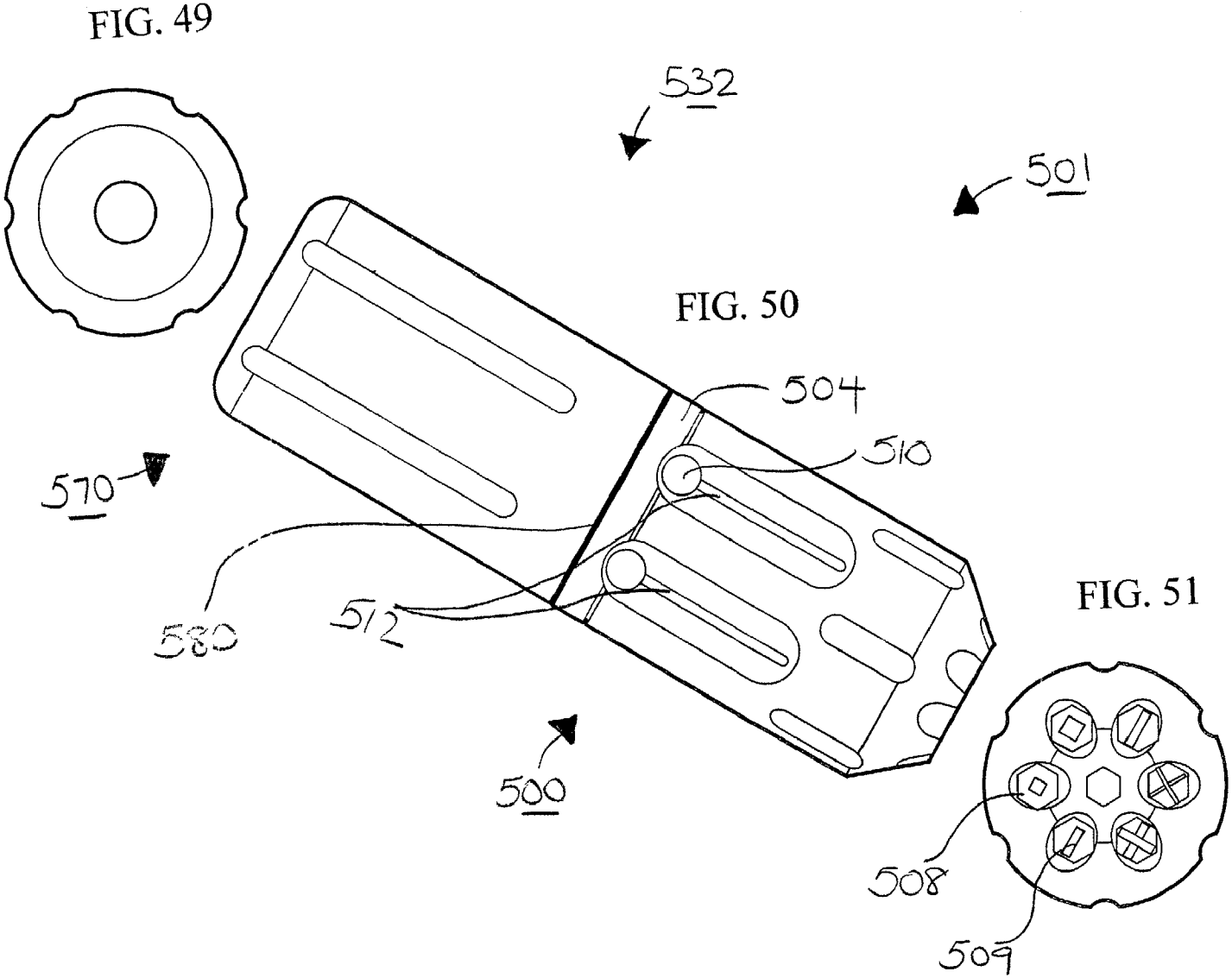
FIG. 49 a bottom plan view of the combination screw driver.
FIG. 50 is a side elevational view of the combination screw driver shown in the attached position.
FIG. 51 is a top plan view of the combination screw driver.
Figure 52:
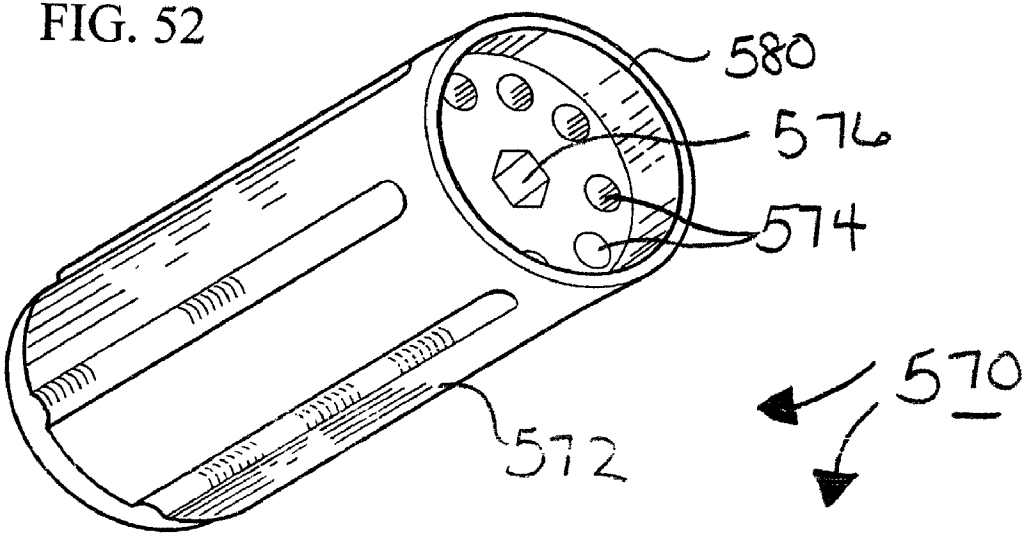
FIG. 52 is a perspective schematic view of the handle of the combination screw driver.
Figure 53:
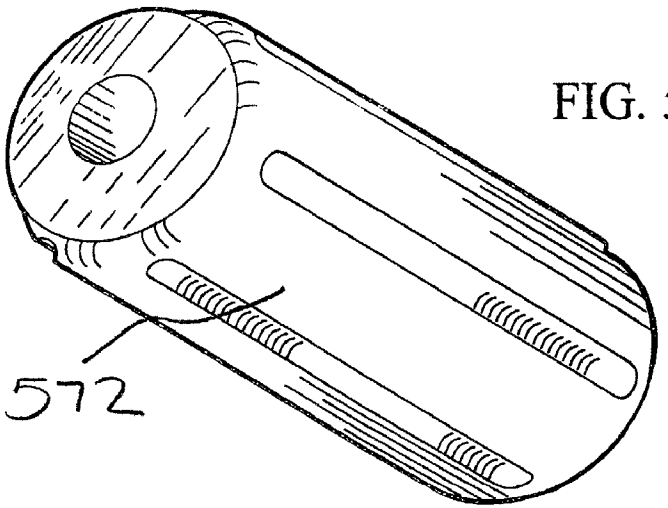
FIG. 53 is a rear schematic perspective view of the handle.
Figure 54:
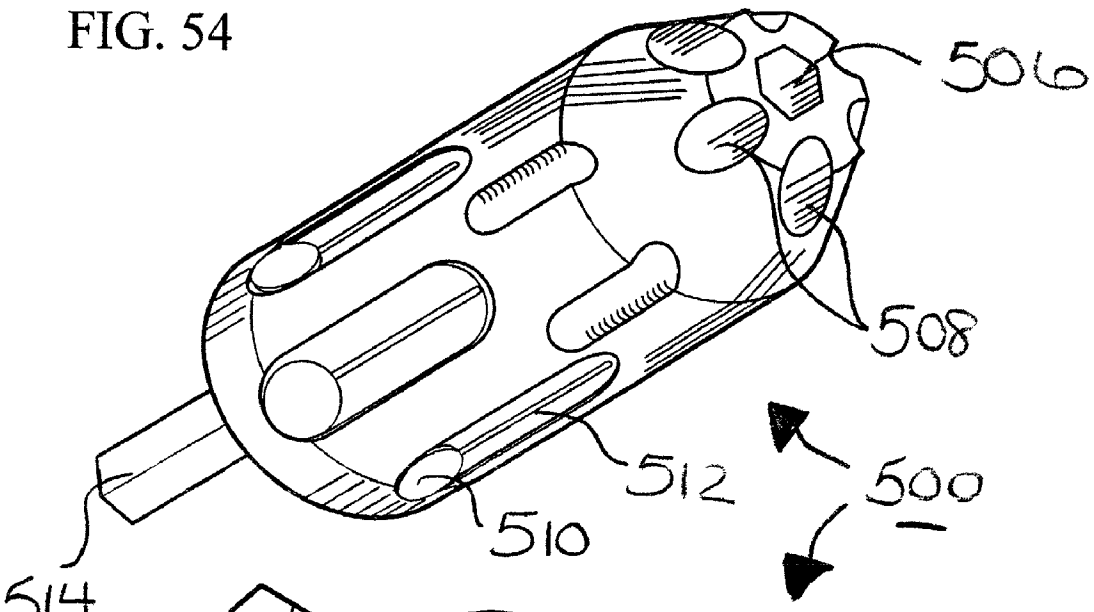
FIG. 54 is a front perspective view of the bit holder as shown in FIG. 50.
Figure 55:
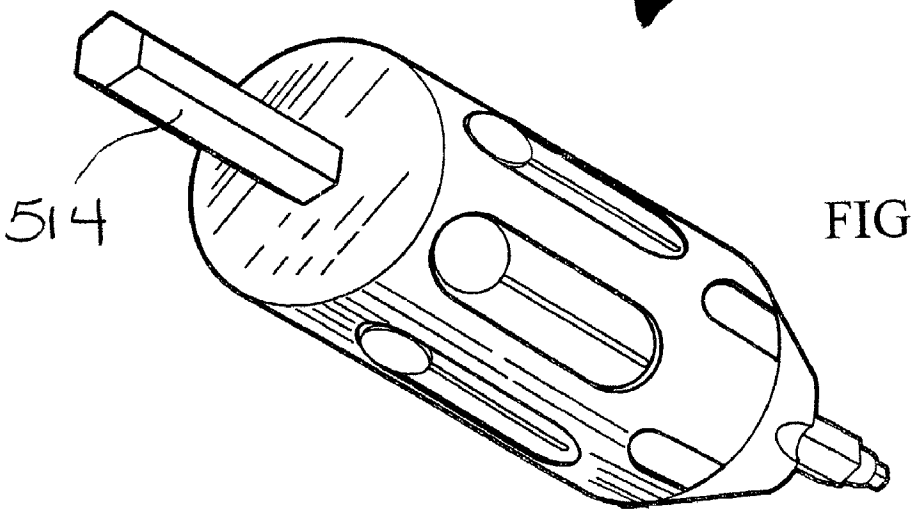
FIG. 55 is a rear perspective view of the bit holder as shown in FIG. 50.
Figure 56:
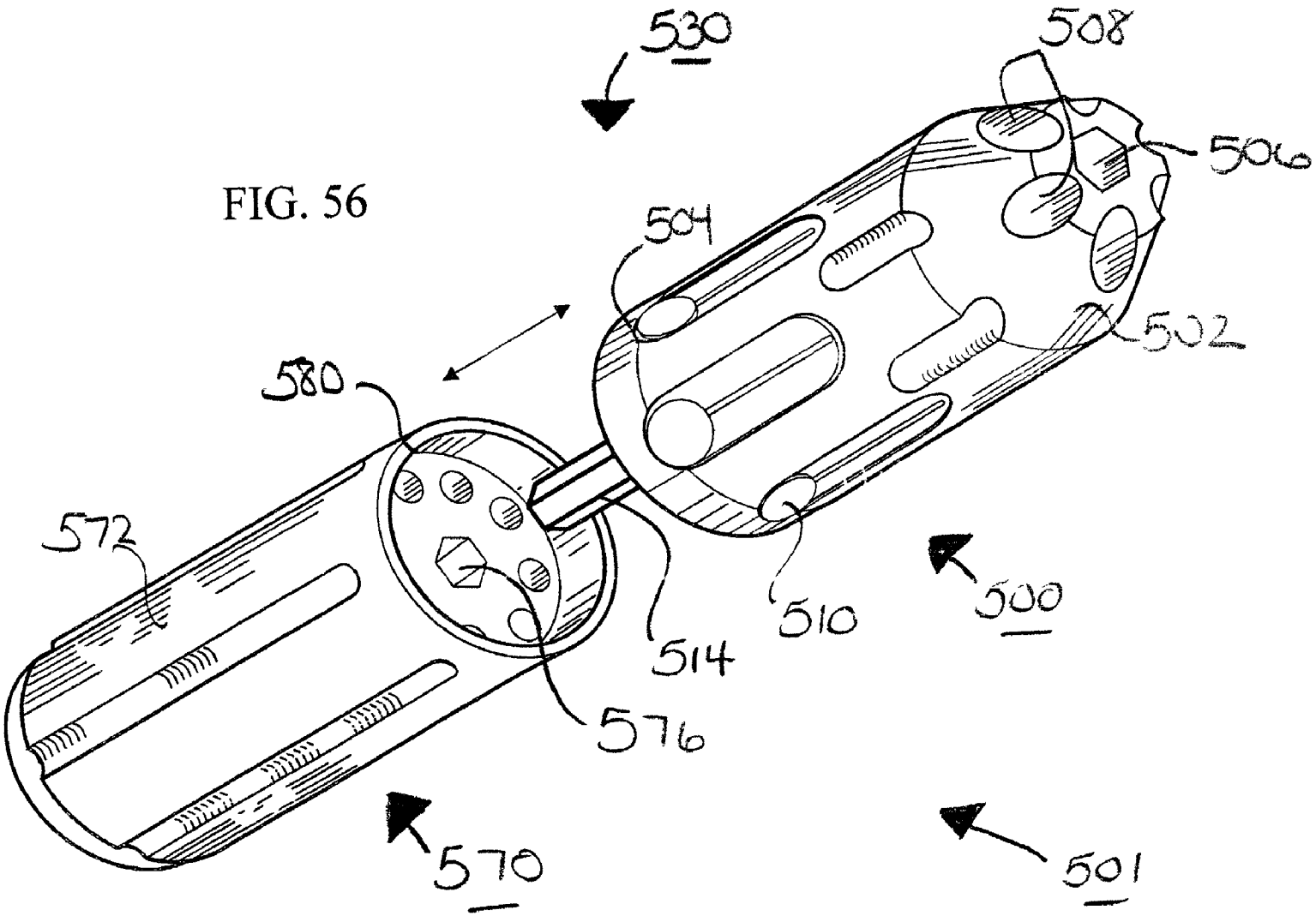
FIG. 56 shows the handle and the bit holder in schematic perspective view in the detached position.
Figure 57:
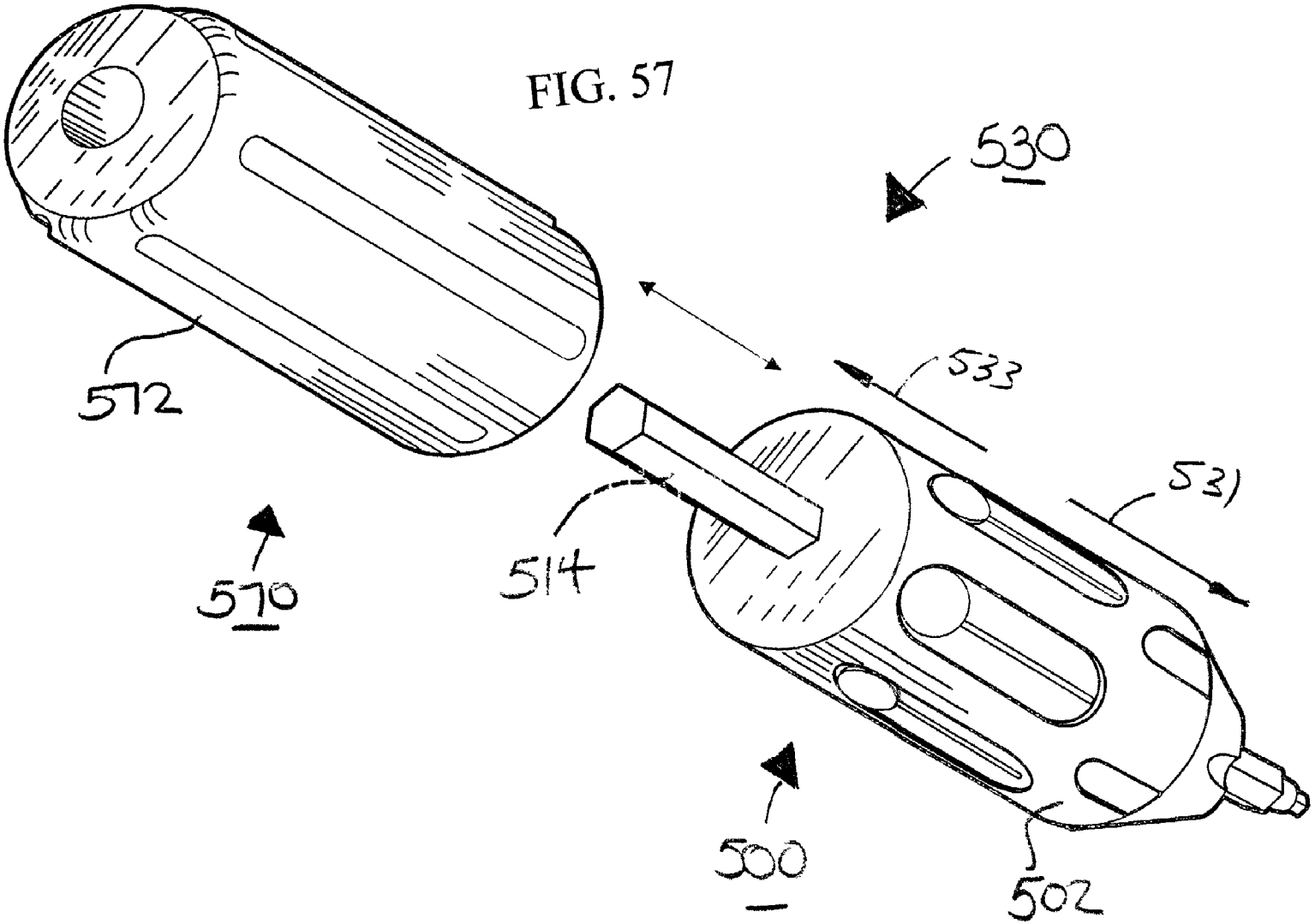
FIG. 57 shows the handle and the bit holder schematically in the detached position.
Figure 58:
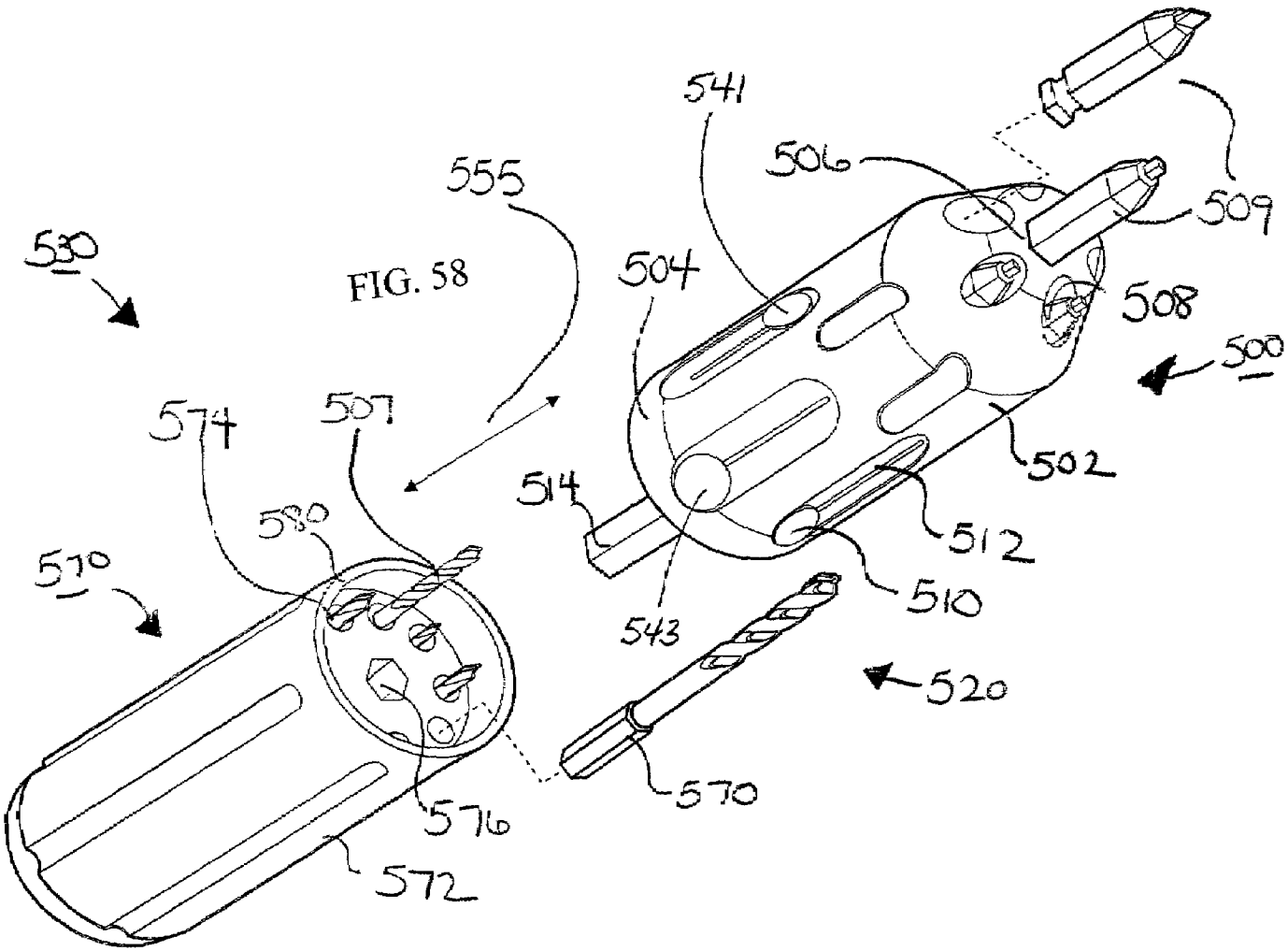
FIG. 58 is a partially exploded view of the bit holder and handle shown in FIG. 50 in the detached position indicating storage of drill bits and tool bits in their respective compartments.

Handle 570 includes the following major components, namely handle body 572 having bit compartments 574, housing drill bits 507. Handle body 572 also includes a centrally located shaft aperture 576 and a mating surface 580. As depicted in FIG. 58, showing the bit holder 500 and the handle 570 in the detached position 530, bit holder 500 can be mated to handle 570 by urging them together in the longitudinal direction 555 in such a manner that shaft 514 is received into shaft aperture 576 of handle 570. In the attached position 532 as best shown in FIG. 50, mating surface 580 butts up to end cap 504 thereby producing a combination screw driver 501 as depicted in FIG. 50. In this manner, one can grip handle 570 in the hand and bits 509 can be selected from bit holder 500 as previously described and placed into socket 506 and in this manner combination screw driver 501 can be used as a manually operated screw driver. By urging in the longitudinal direction 555, bit holder 500 away from handle 570 and into the detached position 530 one can select further drill bits 507 which are stored within bit compartment 574 of handle body 572. Furthermore, one can detach handle 570 from bit holder 500 completely and mount bit holder 500 into a drill chuck as shown in FIG. 68.

In this manner it will become apparent to those skilled in the art that bit holder 500 can be used independently of combination screw driver 501 in which case it would be mounted into a chuck of a drill and this manner one can select various tools bits 509 from either housing 502 or out of handle body 572.

Depending upon the requirements of the user, one can attach bit holder 500 to handle 570 as depicted in FIG. 50 and in this manner the handle 570 together with bit holder 500 can be used as a manual screw driver.

An Alternate Embodiment

Figure 70:
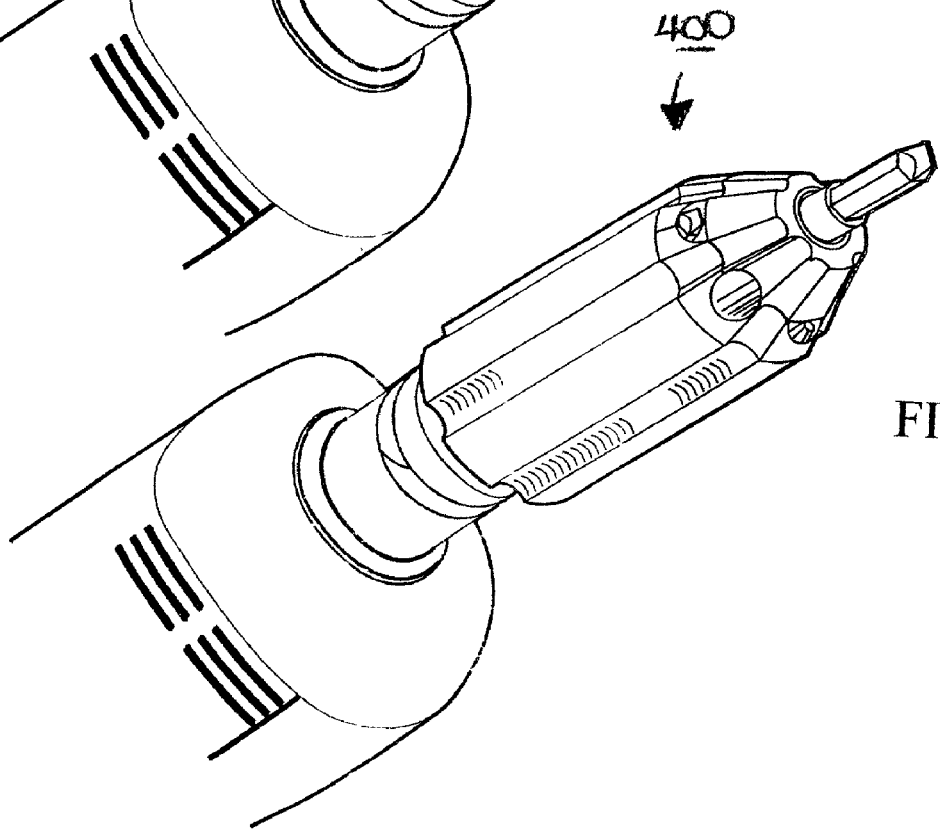
FIG. 70 is a front schematic perspective view of the bit holder shown in FIG. 61 diploid onto a screw driver.

Referring now to FIGS. 60 through 64 as well as FIG. 70, bit holder 500 as described in combination screw driver 501 can be replaced with bit holder 400 which is analogous and identical to bit holder 400 described above. The only difference between bit holder 400 described above and the one depicted in FIG. 61 for example is the fact that body 402 has been slightly elongated to accommodate a longer tool bit 309. In all other manners, bit holder 400 depicted in 61 operates identically and analogous to bit holder 400 depicted in FIG. 48. Those skilled in the art will recognize that the length of bit holder 400 does not affect the functioning of combination screw driver 601 and is selected depending upon the users requirements.

Combination screw driver 601 operates in identical fashion as combination screw driver 501 with the exception that bit holder 400 operates on the principle of the bit holder described above, namely that in order to select a certain tool bit 309, sleeve 404 can be indexably rotated, such that opening 328 aligns with a bit compartment 308 to release a tool bit 309 from a compartment and placed into socket 342.

Similarly to combination screw driver 501, bit holder 400 can be mounted independently of handle 570 into a drill chuck as depicted in FIG. 70 and/or handle 570 can be mounted together with bit holder 400 in the attached position as shown as 399, wherein the combination handle 570 and bit holder 400 can be utilized as a manual screw driver, namely combination screw driver 601.

Alternate Embodiment

Figures 65, 66, 67:
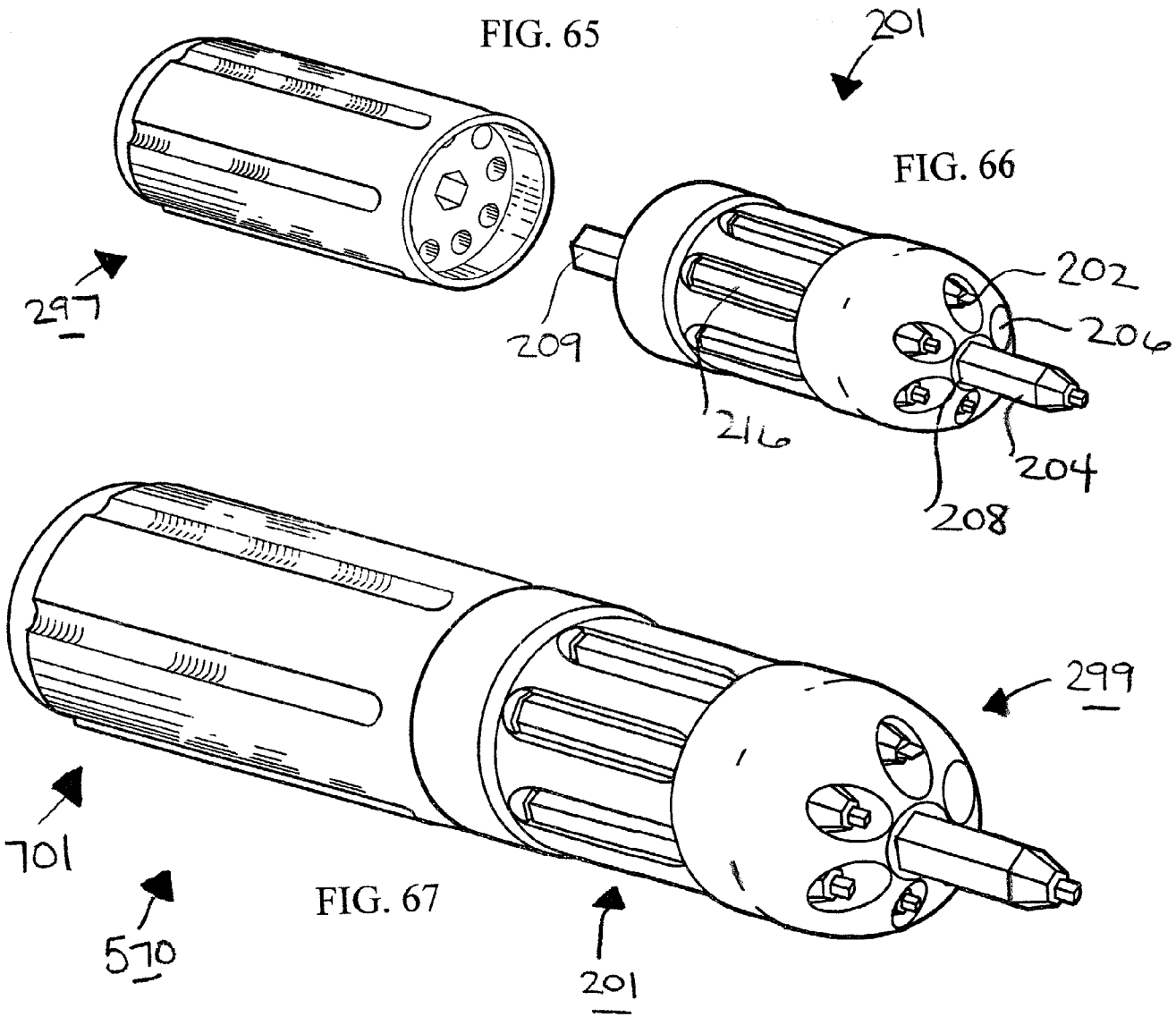
FIG. 65 is a front perspective view of the handle.
FIG. 66 is a front perspective view of an alternate embodiment of the bit holder.
FIG. 67 is an alternate embodiment of a combination screw driver in the attached position.
Figure 69:
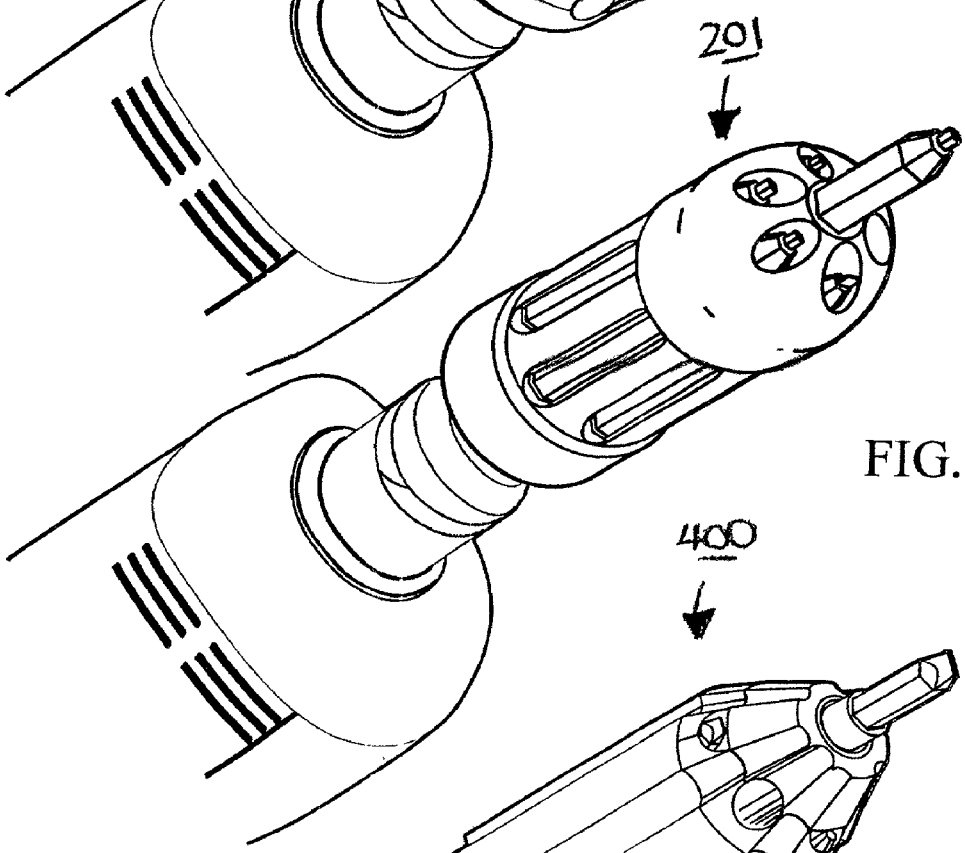
FIG. 69 is a front schematic perspective view of the bit holder shown in FIG. 66 diploid onto a drill chuck.

Finally referring to FIG. 65 through 67 as well as FIG. 69, an alternate embodiment of the present invention, combination screw driver 701, is comprised of bit holder 201 together with handle 470 shown in the attached position 299 in FIG. 67. Bit holder 201 differs slightly from the above described bit holder 200 in that rather than having a threaded aperture 214 at the rear portion of housing 202 of bit holder 201, instead has a shaft 209 rigidly attached and aligned longitudinally in housing 202 as depicted in order that bit holder 201 can mate with handle 570 as shown in the drawings. In all other aspects, bit holder 201 is identical having bit compartments 206, compartment openings 216, bits 204 and tool bits 204 are selected by urging a tool bit manually using finger pressure through the exposed compartment opening 216, thereby allowing a bit to be detached from magnet 212 and placed into hex socket 208 of bit holder 200.

As in the previously described embodiments, bit holder 201 can be used independently of combination screw driver 701 by placing the bit holder in the detached position 297 and into a drill chuck as depicted in FIG. 69 and/or bit holder 201 can be mated together with handle 570 and placed in the attached position 299 as shown in 67 wherein the combination screw driver 701 can be used as a manual screw driver.

It should be apparent to persons skilled in the arts that various modifications and adaptation of this structure described above are possible without departure from the spirit of the invention the scope of which defined in the appended claim.

I claim:

1. A screwdriver including a handle and a detachable drill attachment for mounting into a drill chuck, said screwdriver comprising:

(a) a drill attachment including a central longitudinal shaft means adapted at a rear end for selectively releasably mounting into a drill chuck or a handle, and adapted at a front end for releasably mounting tool bits projecting forwardly from said front end and for rotatably driving said tool bits;

(b) the drill attachment including a storing means mounted onto said shaft means such that said shaft means rear end projecting rearwardly from said storing means for mounting into a drill chuck, and said shaft means front end projecting forwardly from said storing means;

(c) wherein said storing means for releasably storing multiple tool bits in longitudinally oriented bit compartments spaced from and nested around said central shaft means such that said bits are securely held in place upon rotation of said drill attachment by a drill;

(d) the handle including an elongated body, said handle including one end adapted to receive and releasably mourn onto the shaft means rear end of said drill attachment such that said drill attachment can be mated together with said handle for use as a manual screwdriver and said drill attachment can be detached from said handle for mounting into a drill chuck.

2. The screwdriver claimed in claim 1 wherein said handle includes at one end a shaft aperture adapted to longitudinally slideably receive said shaft means rear end therein, thereby releasably holding said drill attachment onto said handle such that upon turning said handle rotational torque is transmitted from said handle to said drill attachment.

3. The screwdriver claimed in claim 2 wherein said shaft aperture including at least one flat portion and said shaft means rear end including a corresponding flat portion for slideably mating and engaging with said shaft aperture.

4. The screwdriver claimed in claim 3 wherein said shaft aperture including six flat portions defining an hexagonal shaped aperture and said shaft means rear end including a corresponding hexagonal shaped portion for slideably mating and engaging with said shaft aperture.

5. The screwdriver claimed in claim 1 wherein said storing means including a retaining means for selectively opening and closing said bit compartments thereby selectively retaining or releasing a tool bit.

6. The screwdriver claimed in claim 5 wherein said storing means including a body and said retaining means including a sleeve, wherein said body and sleeve are cooperatively mounted on said shaft means such that said sleeve is rotatable about said shaft means for selectively opening or closing said bit compartments.

7. The screwdriver claimed in claim 6 wherein said sleeve includes an opening for selectively aligning with a bit compartment and thereby releasing a tool bit from a bit compartment.

8. The screwdriver claimed in claim 7 wherein said storing means including a means for incrementally indexing said sleeve relative said body in an incremental or clicking fashion about said longitudinal shaft, such that sleeve positions are positively registered in predetermined positions or increments.

9. The screwdriver claimed in claim 8 wherein said incremental indexing means includes radially disposed grooves and co-operating tongues, such that rotating said sleeve relative to said body causes said tongues and groves to mesh at predetermined intervals and thereby releasably maintain said sleeve at predetermined indexed positions relative to said body.

10. The screwdriver claimed in claim 9 wherein said body including forwardly projecting tongues for cooperatively engaging with radially disposed grooves in said sleeve such that said sleeve grooves, and body tongues mesh at predetermined rotational intervals for selectively rotatably indexing said sleeve.

11. The screwdriver claimed in claim 5 wherein said storing means including a body and said retaining means including a sleeve, wherein said body and sleeve are cooperatively mounted on said shaft means such that said body is rotatable about said shaft means for selectively opening or closing said bit compartments.

12. The bit holder claimed in claim 1 wherein said staring means being press fit onto said shaft.

13. A screwdriver including a handle and a detachable drill attachment for mounting into a drill chuck, said screwdriver comprising:

(a) a housing aligned and rotatable about a longitudinal axis, said housing adapted at the front end for releasably mounting and presenting a tool bit aligned along said longitudinal axis and projecting forwardly from said housing and for rotatably driving said tool bits;

(b) said drill attachment including a shaft connected at one end to the housing rear end, said shaft longitudinally oriented and rearwardly projecting, wherein said rearwardly projecting portion of said shaft adapted for mounting to a drill chuck and a handle;

(c) said housing including a means for releasably storing multiple tool bits in longitudinally oriented bit compartments spaced from and nested around said longitudinal axis such that said bits are securely held in place upon rotation of said drill attachment by a drill;

(d) the handle including an elongated body, said handle including one end adapted to receive and releasably mount onto the rearwardly projecting shaft of said drill attachment such that said drill attachment can be selectively mated together with said handle for use as a manual screwdriver or said drill attachment can be selectively detached from said handle for mounting into a drill chuck.

14. The screwdriver claimed in claim 13 wherein said handle includes a shaft aperture adapted to longitudinally slideably receive said shaft therein, thereby releasably holding said drill attachment onto said handle such that upon turning said handle rotational torque is transmitted from said handle to said drill attachment.

15. The screwdriver claimed in claim 14 wherein said shaft aperture including at least one flat portion and said shaft including a corresponding flat portion for slideably mating and engaging with said shaft aperture.

16. The screwdriver claimed in claim 13 wherein said shaft aperture including six flat portions defining a corresponding hexagonal shaped aperture and said shaft including an hexagonal shaped portion for slideably mating and engaging wit said shaft aperture.

17. The bit holder claimed in claim 13 wherein said storing means includes an actuating means for magnetically retaining tool bits within each bit compartment.

18. The screwdriver claimed in claim 17 wherein said actuating means includes an actuator assembly slidably received within each bit compartment, wherein said actuator assembly including a magnet housed within a magnet holder for magnetically attracting and retaining a tool bit within a bit compartment.

19. The screwdriver claimed in claim 18 wherein said housing further including actuator channels corresponding to each bit compartment, wherein said actuator assembly being slidably received along each actuator channel and bit compartment, wherein said actuator assembly for slidably urging said tool bit longitudinally along said bit compartment.

20. The screwdriver claimed in claim 19 wherein said actuator assembly further including a knob connected to said magnet holder, said knob projecting from the exterior of said housing for receiving finger pressure thereon, such that tool bits can be extended and refracted along said bit compartment by urging said knob forwards and backwards along the longitudinal direction which inturn urges said actuator assembly and inturn urges said tool bit forwards and backwards.

21. A screwdriver including a handle and a detachable drill attachment for mounting onto a threaded output shaft of a power drill, said screwdriver comprising:

(a) a drill attachment including a housing aligned and rotatable about a longitudinal axis, said housing including a treaded aperture at a rear end adapted for mounting to a threaded output shaft of a power drill and a handle, said housing adapted at the front end for releasably mounting and presenting a tool bit aligned along said longitudinal axis and projecting forwardly from said housing;

(b) said housing further including a means for releasably storing multiple tool bits in bit compartments nested around said longitudinal axis such that said housing together with said stored bits rotate in unison about said longitudinal axis and also such that said bits are securely held in place upon rotation of said drill attachment by a drill; and (c) the handle including an elongated body having one end adapted to threadably mount into the housing rear aperture of said drill attachment such that said drill attachment can selectively be mated together with said handle for use as a manual screwdriver or said drill attachment can be selectively detached from said handle for mounting onto a threaded output shaft of a power drill.

22. The screwdriver claimed in claim 21 wherein said handle includes a threaded shaft projecting centrally forwardly from one end of said handle and adapted to threadably engage with said threaded aperture in said rear end of said drill attachment, thereby releasably holding said drill attachment onto said handle such that upon turning said handle rotational torque is transmitted from said handle to said drill attachment.

23. The screwdriver claimed in claim 21 wherein said screwdriver including an adapter shaft threaded on one end for threadably engaging in said housing rear threaded aperture and adapted at an other end for mounting into a drill chuck.

24. The screwdriver claimed in claim 21 wherein said storing means further includes a means for releasably retaining said tool bits within each bit compartment.

25. The screwdriver claimed in claim 24 wherein said retaining means includes magnets for magnetically retaining bits in said bit compartments.

* * * * *